US006624537B2

(12) United States Patent
Westlake

(10) Patent No.: US 6,624,537 B2
(45) Date of Patent: Sep. 23, 2003

(54) PLURAL OUTPUT ELECTRIC TRAIN CONTROL STATION

(75) Inventor: Richard Westlake, Hillsboro, OR (US)

(73) Assignee: MTH Electrical Trains, Inc., Columbia, MD (US)

( * ) Notice: Subject to any disclaimer, the term of this patent is extended or adjusted under 35 U.S.C. 154(b) by 0 days.

(21) Appl. No.: 09/812,340

(22) Filed: Mar. 20, 2001

(65) Prior Publication Data

US 2001/0015578 A1 Aug. 23, 2001

Related U.S. Application Data

(63) Continuation of application No. 09/212,231, filed on Dec. 16, 1998, now Pat. No. 6,281,606.

(60) Provisional application No. 60/080,880, filed on Apr. 7, 1998.

(51) Int. Cl.[7] ..... H01H 47/00

(52) U.S. Cl. ..... 307/125; 307/81; 307/140

(58) Field of Search ..... 307/125, 140, 307/81; 363/98, 15, 74

(56) References Cited

U.S. PATENT DOCUMENTS 5,635,826 A * 6/1997 Sugawara ..... 323/300
5,642,269 A * 6/1997 Kanouda et al. ..... 363/20
6,021,058 A * 2/2000 Yasohara et al. ..... 363/98

* cited by examiner

*Primary Examiner*—Brian Sircus
*Assistant Examiner*—Robert L. Deberadinis
(74) *Attorney, Agent, or Firm*—Dann Dorfman Herrell and Skillman, P.C.

(57) ABSTRACT

A plural output control station for operating electrical apparatus, such as model electric train engines and accessories. The control station employs a data processor for monitoring and controlling the signals generated at a plurality of transformer-driven power output terminals. An exemplary station includes two variable-voltage alternating current (AC) output channels (TRACK 1 and TRACK 2) and two fixed-voltage AC output channels (AUX 1 & AUX 2). The variable-voltage outputs are controlled by a data processor responsive to respective operator-controlled throttles for varying the AC output voltage and therefore the rate of movement and direction of electric train engines, typically three-rail O-gauge model trains. The variable-voltage outputs can also be offset by the data processor with positive and negative DC voltages for enabling engine functions such as horns, whistles and bells. The variable-voltage outputs are controlled by the data processor to also communicate control parameters to electric train engines for the operation and programming of various electric train engine features and accessories. The plurality of outputs are monitored by the data processor to ensure that predetermined voltage and/or current limits are not exceeded by any individual output and that a predetermined power limit is not exceeded by any individual output or by any combination of outputs.

13 Claims, 20 Drawing Sheets

PLURAL OUTPUT ELECTRIC TRAIN CONTROL STATION

RELATED APPLICATION

This application is a continuation of co-pending application Ser. No. 09/212,231, entitled "PLURAL OUTPUT ELECTRIC TRAIN CONTROL STATION", filed on Dec. 16, 1998 now U.S. Pat. No. 6,281,606, which is a continuation of U.S. Provisional appln. Ser. No. 60/080,880, filed Apr. 7, 1998, such applications being incorporated herein by reference.

FIELD OF THE INVENTION

This invention relates to the control of plural electrical signals. More particularly, this invention relates to a microprocessor-controlled control station for the delivery and monitoring of plural electrical signals to a utilization device.

BACKGROUND OF THE INVENTION

Electrical apparatus rarely is operable on the available electrical power in the form in which it is received from the source, be that a generator, power supply or the common 110V AC wall outlet. Consequently, electrical controls are provided to adapt the available electrical supply to the form, i.e. the voltages, currents and power levels, required by the apparatus. Conventionally, transformers, with or without voltage and/or current converters, perform this function. But in addition to the function of such conversion, protection requirements for personnel and equipment must be satisfied. In addition, programmable control over the output voltages may also be desired.

One field in which this need exists is that of model electric trains. Many of these are sold as toys to be used by children and so the protection of personnel must be a principal concern. Others are sold to model railroad enthusiasts who desire realistic operation and so the programmable control feature is important to these persons.

Generally, operation of model electric trains is facilitated by an electric transformer which is operatively linked to a model train track circuit of a model train layout. The transformer provides an electric power signal to the model train track which is coupled to an internal motor of the electric train engine, typically by way of metallic wheels or contacts electrically contacting the track. In O-gauge systems, the voltage required to drive the engine is an AC voltage, unlike typical HO-gauge systems which employ a DC voltage.

Model train enthusiasts, especially those preferring the O-gauge scale, have long had available the line of products manufactured by Lionel Trains Inc., now of New Baltimore, Mich. Such model train products were introduced in the United States early in the 20th century and experienced their greatest popularity after to World War II. The early popularity of O-gauge electric train products coincided with the widespread use of electrical devices which occurred after World War II and resulted in a de-facto electrical standard in the O-gauge model train industry based on the operation of that type of transformer and motorized train engine. As such, O-gauge train engines and accessories such as those currently manufactured by Mike's Train House (MTH and Rail King brand trains) and others are designed to operate on electrical signals consistent with the type standardized by the old standard O-gauge transformer stations.

Standard O-gauge electrical train operation is characterized by an AC track signal, wherein the AC signal is switchably offset by a DC signal used to enable various train accessories such as the horn/whistle function. The AC track signal energizes the electric motor of the train engine, with the DC offset enabling a train engine relay unit to activate the appropriate bell or whistle feature. Additionally, certain standard O-gauge type transformers include fixed AC voltage supply terminals for operating lights and additional accessories.

This basic electrical standard, namely the AC track signal voltage and DC control offset popularized by the standard O-gauge transformer, has been adhered to by current manufacturers to ensure compatibility of their products and accessories with those already in use. The standardization of this power arrangement ensures the continued compatibility of vintage train engines with new engines and other model train technologies.

Presently, hobbyists either recondition vintage standard O-gauge transformers or rely on new compatible transformers to power their O-gauge layouts. Yet, reconditioned transformers on their own cannot readily take advantage of modern train sound effects and control technologies and they lack the capabilities necessary to intelligently control and monitor system accessories and power consumption. Moreover, new transformers are incapable of delivering the power associated with vintage standard O-gauge transformers because they must comply with more stringent modern electrical safety standards, such as those promulgated by Underwriters Laboratory (UL).

Accordingly, there is a need for an electric control station that provides power supply limiting and data processing for intelligently monitoring and controlling power consumption. In particular, a plural output electric control station is needed that manages the power capacity of a plurality of outputs to ensure that a maximum power rating is not exceeded by a single output or by any combination of outputs. Additionally, a station is needed to provide an adaptive control for integrating and programming new train accessory technologies.

SUMMARY OF THE INVENTION

Accordingly, electrical control apparatus according to the present invention comprises at least two outputs at which respective first and second electrical signals are to be produced. A controllable first electrical source is coupled to at least one of the outputs for supplying the first electrical signals, wherein the controllable electrical source is responsive to a first control signal for controlling the magnitude of the first electrical signal. A second electrical source is coupled to the other of the outputs for supplying said second electrical signal. A sensing element is coupled to receive the first electrical signal and to generate a sensed electrical parameter representative of the magnitude of said first electrical signal. A processor is responsive to the sensed electrical parameter for generating the first control signal.

According to another aspect according to the present invention, an electric train control station comprises an input connection adapted to receive electrical power from a source of electrical power and an output connection adapted to supply a controlled electrical signal for a track circuit. A controllable drive circuit is coupled between the input connection and the output connection for generating the controlled electrical signal in response to a first control signal. An input device generates a command signal in response to an operator action and a data processor includes a memory device for storing an instruction set. The data processor executes the instruction set and is coupled to the input device and to the controllable drive circuit to generate the first control signal in response to the command signal and in accordance with the instruction set.

In a further aspect according to the present invention, a method of detecting an interconnection of at least two outputs of a plural output electrical control station, wherein at least one of the outputs is controllable in response to a control value, comprises the steps of: measuring a reference measured value of the voltage at at least one of the outputs thereof; changing the control value of the controllable output in a manner expected to produce a predetermined change of the voltage thereof; calculating from the reference value and the predetermined change an expected value of a second measured value of the voltage at the controllable output; measuring at the at least one of the outputs after the changing the control value of the controllable output the second measured value of the voltage thereof; comparing the second measured value to the calculated expected value; and detecting an interconnection when the second measured value differs from the calculated expected value by more than a predetermined amount.

BRIEF DESCRIPTION OF THE DRAWING

The foregoing summary, and the following detailed description, will be best understood when read in conjunction with the attached drawing, in which.

DETAILED DESCRIPTION OF THE PREFERRED EMBODIMENT

Figure 1:
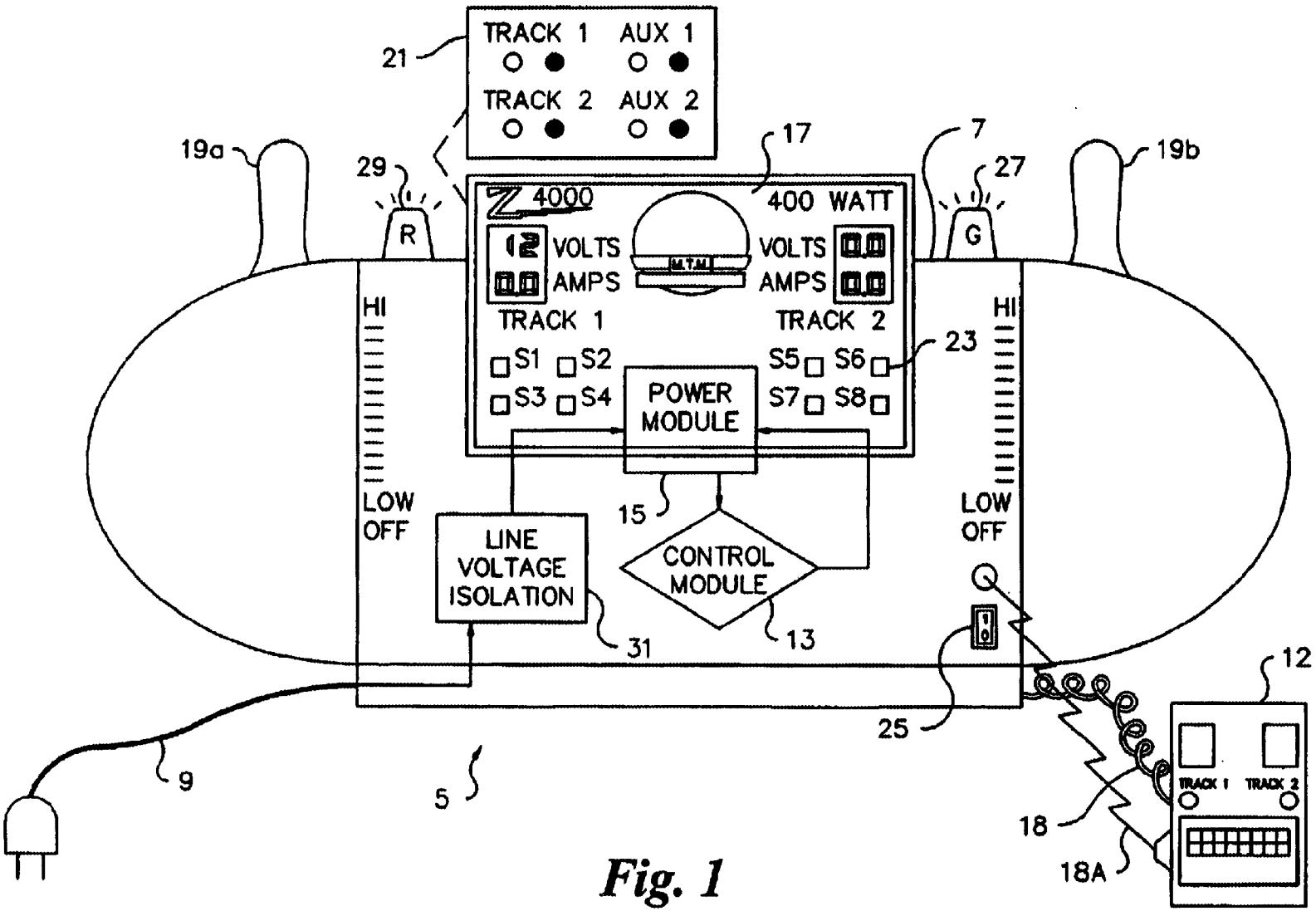
FIG. 1 is a plan view of an embodiment of a plural output electric control station the present invention.

The present invention is applicable to a plural-output electric control station for use in powering, for example, electric trains and accessories, to a preselected power capacity limit. The preselected limit typically defines a range of maximum power capacity such as those mandated by the Underwriters Laboratory (UL) for electric train transformers. The electric train control station described herein below is a plural output power supply and data processing system for intelligently monitoring/controlling a plurality of transformer-powered output terminals while providing an adaptive control arrangement for integrating and programming new and existing train control and accessory technologies.

The control station typically provides two variable-voltage alternating current (AC) outputs (TRACK 1 and TRACK 2) and two fixed-voltage (AC) outputs (AUX1 and AUX2). The variable-voltage outputs are provided for connection to a circuit of electric train track for communicating with and powering electric train engines and other devices placed thereon. The two variable-voltage outputs are enabled by two operator controlled throttles for varying the AC voltage, and therefore the rate of movement and direction of electric train engines. The variable AC voltage can be offset with a DC voltage for actuating engine functions, such as horns and whistles typically found on standard O-gauge electric trains. The two fixed outputs are provided for powering electric train accessories, typically lighting circuits.

The train control station may for convenience include a number of circuit sections or modules, namely: a line voltage isolation section, a power module, and a control module. Each module includes sub-circuits for the management and/or control of the station output voltages and for establishing communication with electric train engines for the powering of electric motors and the automated selection of engine reset control options.

The line voltage isolation section electrically isolates of the AC power supply line from the control station outputs to decrease the risk of shock, burn and fire hazards. The power module supplies electrical power to the plural output terminals of the control station. The control module includes a data processor having a set of stored instructions and interface circuits for managing and actively monitoring the operation of the power module.

The control station further includes a display for indicating output voltage and current levels and for selecting engine reset options. The engine options are selected by way of a display interface which enables the control module to transmit option selection signals to electric train engines. Optionally, the operation of the control station can be established at an additional location by use of a remote control. The control module and the electric train engines communicate through the train track circuit being operatively coupled to the appropriate variable-voltage output terminal.

A preferred embodiment of the device and methods in accordance with the present invention will now be described with reference to the enumerated drawing FIGURES.

Referring to FIG. 1, a plural output electric train control station in accordance with the present invention is shown. The plural output electric train control station, generally designated 5, includes a housing 7, a housing display 17, power cord 9, dual throttles 19*a* and 19*b*, display interface 23, status lights 29 and 27, output section 21, remote control 12, remote control interface 18, and power on-off switch 25.

The housing 7 of station 5 is preferably manufactured of a high-impact-resistant plastic. The housing 7 includes throttles 19*a* and 19*b* which are positioned at opposite sides of station 5. The throttles 19*a* and 19*b* are each rotatably coupled to station 5 for the variation of respective AC track signals. The housing 7 has a display portion 17 for the mounting of a visual display. In the preferred embodiment the visual display is by way of Light Emitting Diodes (LED display) for communicating power and/or programming indicia to an operator, for example, in numerical form. Display interface 23 includes a plurality of switch controls S1, S2, S3, S4, S5, S6, S7, S8 for the programming and/or activation of station 5 for operation of electric trains and electric train accessories. Status lights 29 (red) and 27 (green) on housing 7 are for notifying the operator of operational conditions and power status. For example, green status light 27 may indicate a power on condition and red status light 27 may indicate a fault, overload or shut-down condition.

Power is provided to station 5 by polarized plug and power cord 9 and is turned on and off by power switch 25. Output section 21 of station 5 has two variable-voltage AC outputs TRACK 1 and TRACK 2 which are operator controlled by way of throttles 19*a* and 19*b*, respectively, and two fixed-voltage AC outputs AUX 1 and AUX 2. Each of the foregoing outputs is available to the operator on a pair of electrical terminals on output section 21.

The electrical control and management of voltages available at output section 21 is described with respect to three device modules: line isolation transformer 31, power module 15, and control module 13, each module including a number of sub-circuits which are described herein.

Figure 2A:
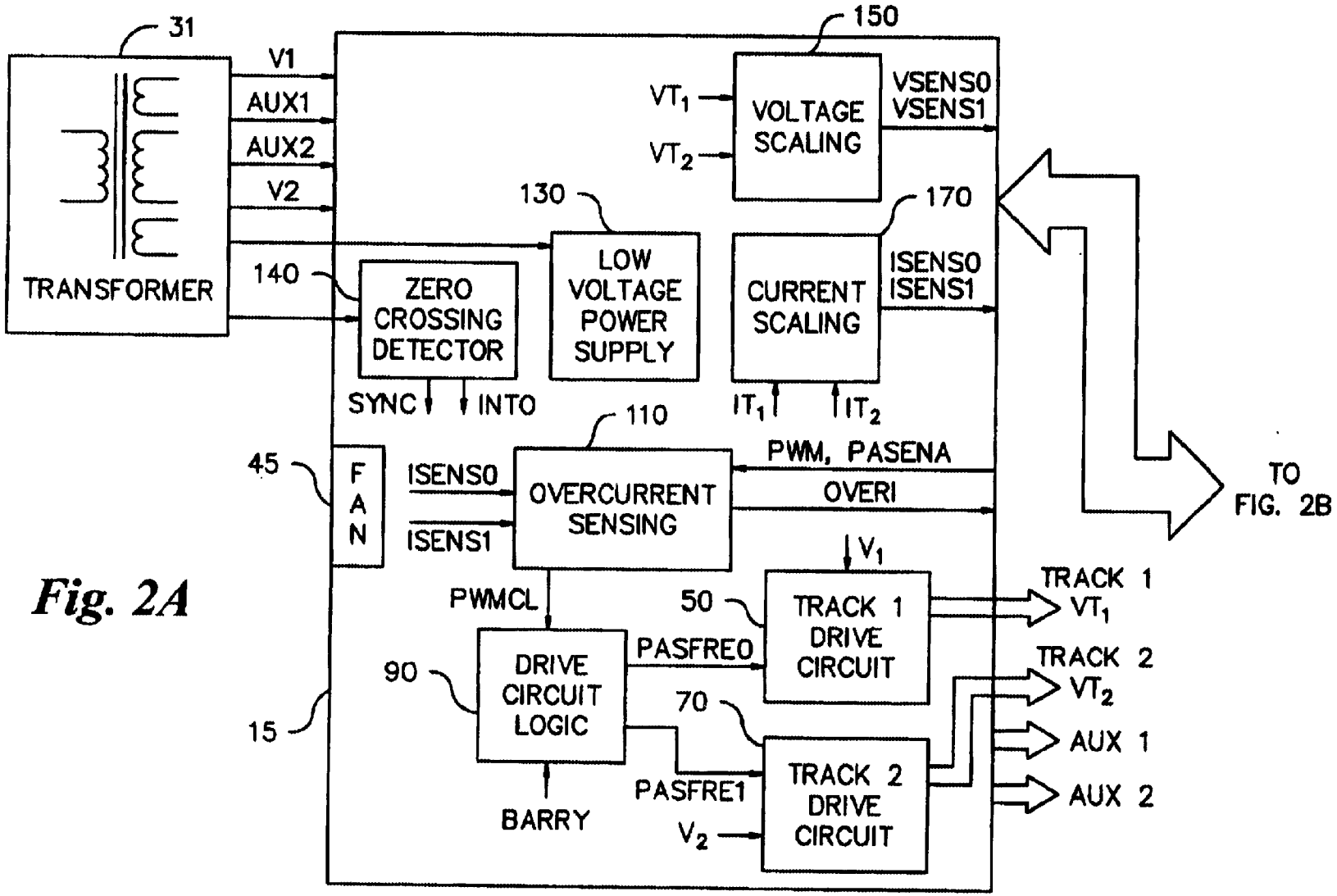
FIG. 2 is a schematic block diagram of the embodiment of FIG. 1 showing a power isolation module, a power module, and a control module of the plural output electric control station.
Figure 2B:
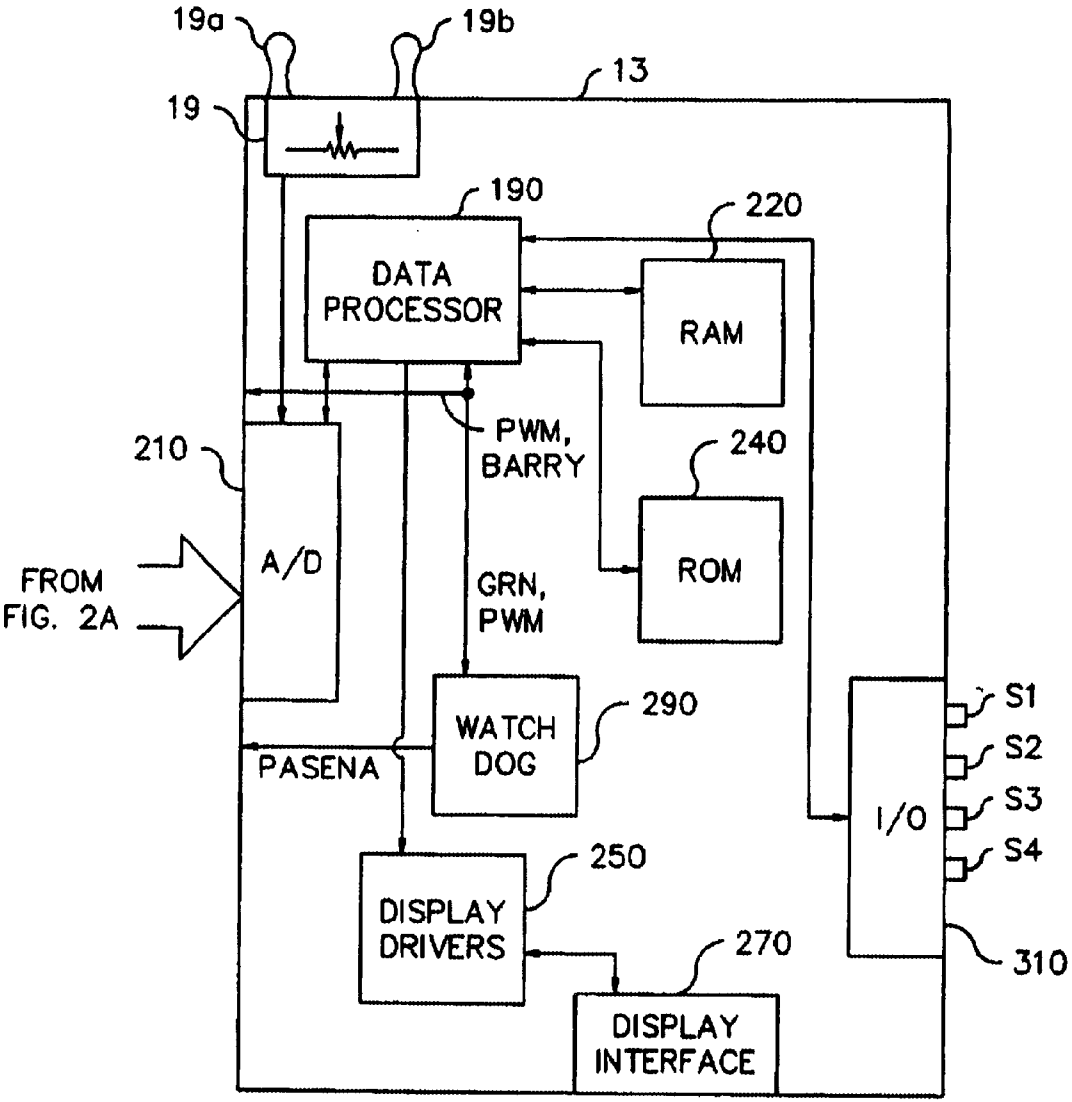
Figure 3:
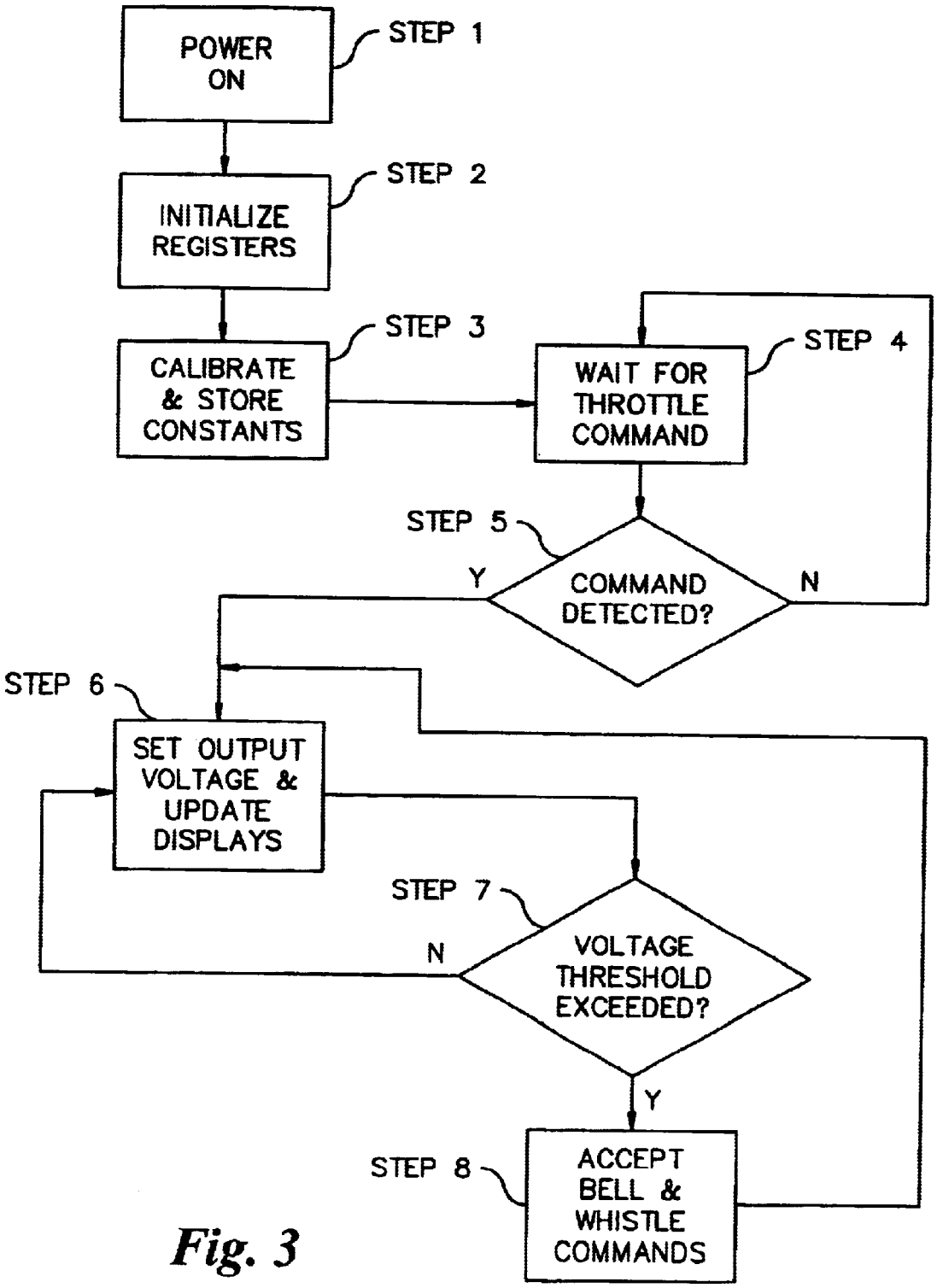
FIG. 3 is a logical flow diagram relating to the operation of the control module portion of the embodiment of FIG. 2.
Figure 4A:
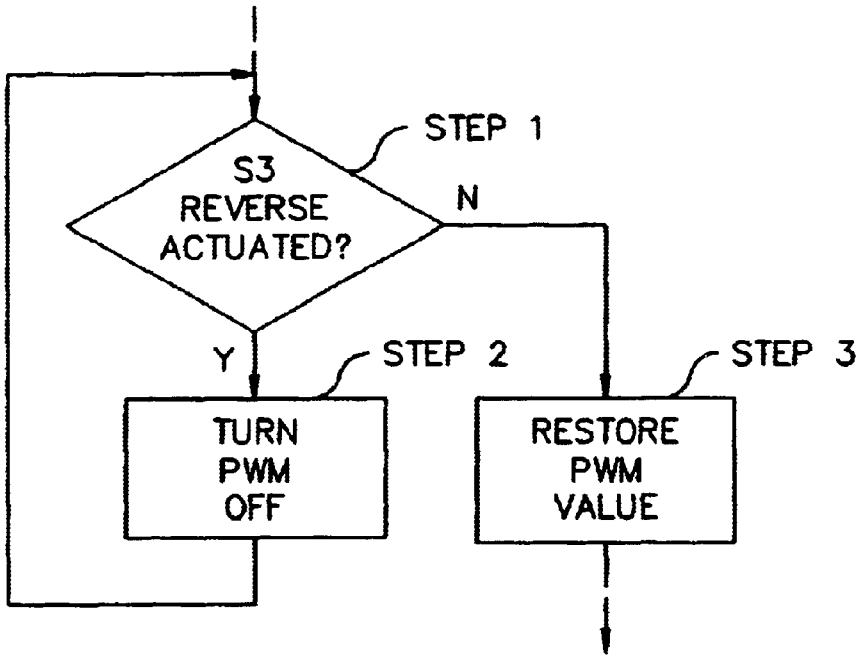
FIG. 4 is a logical flow diagram relating to the operation of certain features of the control module portion of the embodiment of FIG. 2.
Figure 4B:
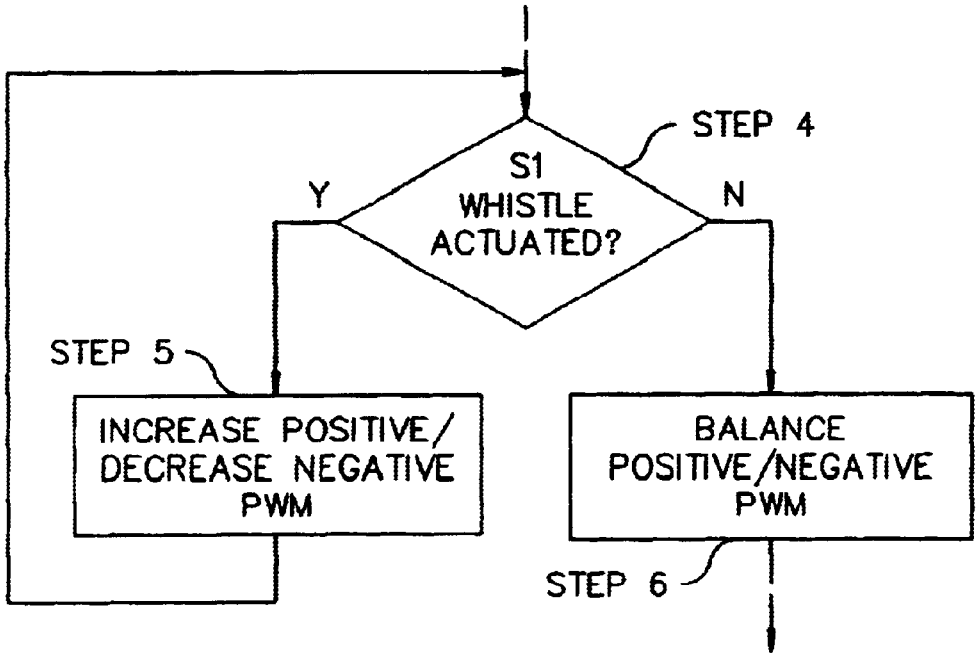
Figure 4C:
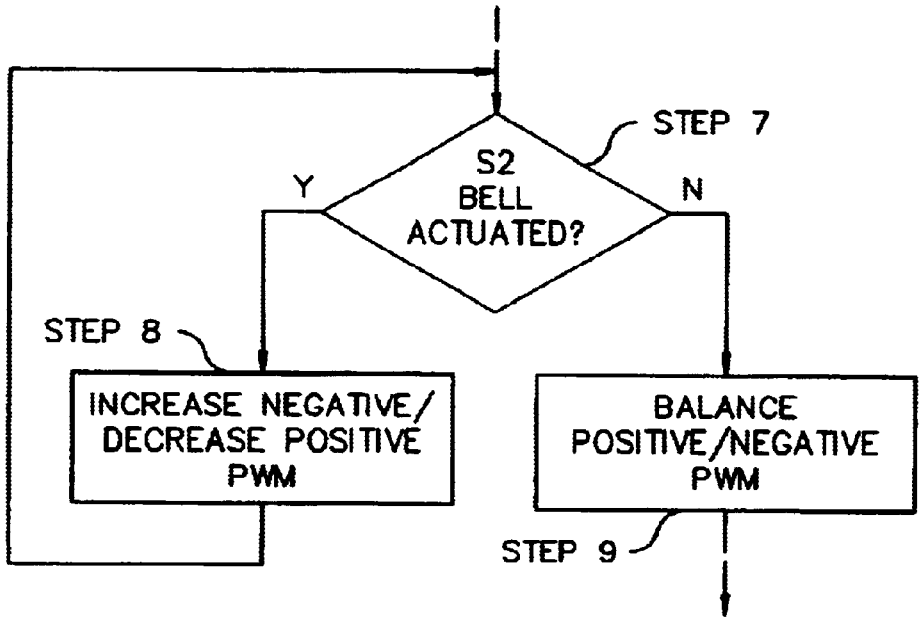
Figure 4D:
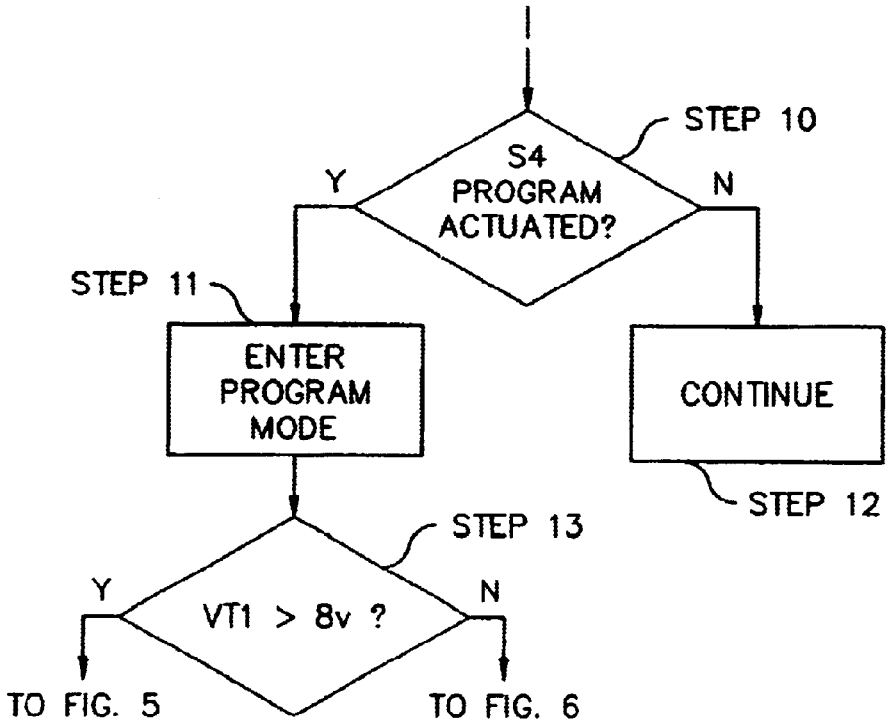

Referring to FIG. 2, AC power from isolation transformer 31 is applied to power module 15 from multiple-output windings. Respective low-voltage AC outputs from transformer 31 are applied to track 1 drive circuit 50 for generating variable-voltage output TRACK 1, to TRACK 2 drive circuit 70 for generating variable-voltage output TRACK 2, to fixed-voltage outputs AUX 1 and AUX 2, and to low-voltage power supplies 130 for generating various direct-current DC voltages required for generating the circuits of modules 13 and 15 and of fan 45. To preserve clarity, distribution of low voltages is not shown.

In FIG. 2, AC voltage is applied to transformer 31 which produces relatively higher power output voltages V1 and V2 from which the TRACK 1 AND TRACK 2, respectively, track driving voltages will be generated, AUX 1 and AUX 2 outputs which are provided directly as the AUX 1 and AUX 2, respectively, fixed-voltage outputs, AC power which is applied to low voltage supply 130 from which it generates the necessary voltages, for example, +12 volts, −12 volts, and +5 volts, needed to operate all the circuitry within power module 15 and control module 13. In addition, transformer 31 provides an AC signal to zero crossing detector 140 which includes comparators for producing synchronization signals SYNC corresponding to the positive and negative half cycles, respectively, of the AC voltages and an interrupt signal INT0 which is a short pulse occurring at the zero-crossing of the AC voltages.

Voltage signals V1 and V2 from transformer 31 are applied to TRACK 1 drive circuit 50 and TRACK 2 drive circuit 70, respectively, which generate therefrom the TRACK 1 signal VT1 and the TRACK 2 signal VT2, respectively, which are applied to track circuits for the operation of model train engines. TRACK 1 drive circuit 50 and TRACK 2 drive circuit 70 each include a pulse width modulated power amplifier which reduces the AC signals V1 and V2, respectively, to a desired variable output voltage VT1 and VT2, respectively, in response to the settings of control handles 19*a* and 19*b* made by an operator. As will be described in greater detail below, the setting of control handles 19*a* and 19*b* is monitored by data processor 190 in control module 13 which produces pulse width modulation signals PWM which are applied through drive circuit logic 90 to control the on-off duty cycle of switching transistors in drive circuits 50 and 70 to produce the proper variable-voltage output TRACK 1 and TRACK 2 outputs, VT1 and VT2, respectively.

Protection against excessive output voltages, output currents and output power is necessary to comply with Government safety standards such as those established by Underwriter's Laboratories (UL) and the Consumer Product Safety Commission (CPSC). To this end overcurrent sensing element 110 receives indications ISENS0 and ISENS1 of the respective currents being provided by TRACK 1 drive circuit 50 and TRACK 2 drive circuit 70. When either of currents IT1 or IT2 exceed a predetermined threshold, for example, 20 amperes, overcurrent sensing element 110 modifies the PWM signal from data processor 190 so as to cause drive circuit logic element 90 to turn off drive circuits 50 and 70, is the case, respectively, at least for the half cycle of the AC voltage waveform in which the overcurrent condition is detected. Overcurrent sensing element 110 receives PWM and PASENA signals from control module 13 and supplies overcurrent indication OVERI to data processor 190. Overcurrent sensing element 110 modifies the PWM signal into signal PWMCL which is the signal PWM, but reduced in those instances where an overcurrent condition is detected by overcurrent sensing element 110 or where PASENA is removed. The signal BARRY is applied to drive circuit logic 90 by control module 13 to immediately shut down gate drive to TRACK drive circuits 50, 70 upon detection by data processor 190 of certain over power conditions to be described below. In addition, indications of currents IT1 and IT2 are applied to current scaling element 170 which amplifies and full-wave rectifies the current indications to provide signals suitable for analog to digital conversion 210 for use by data processor 190. Similarly, TRACK 1 and TRACK 2 voltages VT1 and VT2 are applied to voltage scaling element 150 wherein they are scaled and full-wave rectified so as to be suitable for application to A to D converter 210 and thus for use by data processor 190.

In control module 13, analog current voltage signals from voltage scaling element 150 and analog current indications from current scaling element 170, each having a voltage in the range of zero to +5 volts, are applied to A to D converter 210 wherein they are sampled approximately every 100 microseconds and are stored in random access memory (RAM) 220 under the control of data processor 190. Data processor 190 computes from those voltage and current signals, which may be non-sinusoidal or highly distorted sinusoidal signals owing to the non-linearities in the model train engines and discontinuities caused by poor contacts between wheels on the locomotive and the rails, an rms value for TRACK 1 and TRACK 2 voltages VT1 and VT2 and for TRACK 1 and TRACK 2 currents IT1 and IT2, respectively. Operation of data processor 190 is controlled by instructions stored in read only memory (ROM) 240. For a typical data processor, such as an 80C552 microprocessor commercially available from Philips Corp., the analog to digital converter and the RAM 220 may be internal to the microprocessor. As may be convenient, however, A to D converter 210, RAM 220 and ROM 240 may be conveniently provided by, or be expanded by, external integrated circuits, as is known to those skilled in the art.

Data processor 190 transfers signals indicative of the rms values of voltages VT1 and VT2 and of currents IT1 and IT2 to display driver 250, which is of conventional type, and thence to the display interface, 270, which is also of conventional type, for display to the operator of the voltages applied to and the currents be consumed by each of the TRACK 1 and TRACK 2 circuits.

The operator provides control information by moving handles 19*a* and 19*b* or pushing buttons 23 as shown in FIG. 1, which actions are communicated to data processor 190. Throttles 19*a*, 19*b* are each coupled to a potentiometer 19 to control a dc voltage representative of desired track voltage VT1, VT2 that is communicated to processor 190 by A/D converter 210. Actuation of buttons 23 is communicated to processor 190 by an input/output interface 310. These inputs specifically include four separate push buttons: whistle and horn button S1, bell button S2, direction control button S3 and program button S4, the operation of which will described herein below.

For complying with UL Standard 697, the output voltage of each output of station 5 must be limited to 30 volts AC rms, the output current must be limited to 30 amperes AC rms and the maximum power output must be limited to 190 watts, each of the foregoing limitations must be achieved in no less than one minute from the time the aforementioned levels are exceeded. Data processor 190 under the control of instructions produced from ROM 240 monitors the levels of rms voltages, rms currents and power to ensure that they are within the UL specification limits. If they are not, data processor 190 reduces the count of the PWM signal furnished to power module 15 to reduce the output voltage and/or current produced by drive circuits 50 and 70, whichever the case may be, to be within allowable limits. If data processor 190 is reducing the PWM count as a result of detection of excessive output power and if the power is to decrementing in response thereto, processor 190 generates a signal BARRY to immediately remove gate drive signals from TRACK drive circuits 50, 70 and reduce VT1 and VT2 to zero.

Eight-bit signals are produced by A to D converter 210 for the voltage and current signals from which data processor 190 calculates true rms values in a 24-bit format. Data processor 190 utilizes eight bits for the PWM signals, it having been found that the 255 levels available with eight bit signals are satisfactory.

When data processor 190 computes that the TRACK 1 or TRACK 2 current, voltage or output power exceeds the established UL limit, data processor 190 decrements the appropriate track voltage VT1 or VT2 by reducing the value of the PWM signal that it sends via overcurrent sensing element 110 and drive circuit logic 90 to control drive circuits 50 or 70.

The Underwriter's Laboratory Standard 697 imposes an additional requirement in that the aforementioned limitations of voltage, current and power must be maintained even when the device has sustained a failure of any single component. To comply with this requirement of UL Standard 697, watch dog timer 290 monitors two signals generated by data processor 190: a signal GRN indicative that the processor 190 is cycling and performing instructions and the signal PWM generated by data processor 190 to control track drive circuits 50 and 70. If neither of the signals GRN and PWM are toggling between high and low levels, data processor 190 is not functioning and watch dog timer 290 will time out to change a signal PASENA to a logic low which is applied to the overcurrent sensing element 110 to reduce the duty cycle generated by drive circuit logic element 90 to zero, thereby reducing the output voltage generated by TRACK 1 drive circuit 50 and TRACK 2 drive circuit 70 to zero. In addition, processor 190 produces the signal BARRY as described above to address the UL single component failure requirement.

Data Processor Instruction Set

Additional features of station 5 including protection features and engine features and reset option selection will now be described with reference to FIGS. 3–9 wherein there are shown logical flow diagrams of the various processing procedures executed by the micro controller or data processor 190 of control module 13. In the initialization and operation procedure of FIG. 3, execution begins at step 1 where the micro controller is powered on and initializes all output registers to their default conditions at step 2. The PWM signals are initialized to 0/255, thus the output voltages of TRACK 1 and TRACK 2 are set to 0 volts at step 3. Micro controller 190 performs a partial gain and offset calibration routine on the voltage and current measurement systems of power module 13, and stores the calibration constants, which will be used to calculate voltage and currents in later steps. In step 4 the micro controller 190 waits for the control handles 19*a*, 19*b* to be moved from their minimum or off positions in which the display 17 indicates "00" and the micro controller 190 is enabled to respond to throttle 19*a*, 19*b* position as an output variable-voltage command communicated via potentiometers 19 and A/D converter 210.

As the controls 19*a*, 19*b* are rotated above the minimum position a command is detected, step 5 and the output voltage is set, step 7. Until a "Turn On Threshold" is reached in step 7, the outputs are set to a nominal 5V AC output voltage level in step 6. The actual voltage level is a function of the loading on the variable-voltage output terminals and the input AC line voltage, and can vary from about 3.5 volts with 4 engines to about 9 volts with a single track light. As the controls 19*a*, 19*b* are rotated the output voltage VT1, VT2 increases and decreases in proportion to rotation of the control handles 19*a*, 19*b*.

The voltage and current displays 17 are updated at about 2 times per second to show the then-present values of VT1, VT2, IT1 and IT2 at the variable-voltage output terminals TRACK 1 and TRACK 2, respectively. (Actually the voltage is measured on the power Board and will indicate a slightly higher value than the voltage appearing on the tracks.) Once the TRACK 1 or TRACK 2 output voltage is above the turn on threshold value, step 7, the system will respond, step 8, to the features such as the bell/whistle push buttons of the display interface 23 that control the whistles, bells and other features. Thereafter, station 5 "runs" the trains by causing the variable output voltages TRACK 1 and TRACK 2 to follow the operator commands from control handles 19*a*, 19*b*, respectively, and updates the voltage VT1, VT2 and current IT1, IT2 displays in step 6.

Display interface 23 has two sets of buttons S1, S2, S3, and S4 for TRACK 1 features and S5, S6, S7, and S8 (TRACK 2) for controlling the respective variable-voltage outputs of TRACK 1 and TRACK 2, respectively, for actuating various features and for engine reset option selection. In the following description on the TRACK 1 operation will be described; the TRACK 2 operation is the same as that of TRACK 1.

Whistles, Bells and Running Features

Conventionally, DC offset voltages were generated in ways that adversely affect train operation or other operating parameters. For example, Lionel transformers generated DC offset voltages by simply switching a rectifier in series with the track so that the track (and train) was powered by a half-wave rectified AC signal. While adequate to blow the whistle, the substantial reduction in power caused the train to slow down markedly. The solution was to boost the AC signal by about 5 volts to crudely counteract the power loss. More recent approaches employed amplitude clipping or shortening one half cycle or the other of the AC track signal, but this generated distorted, non-sinusoidal track voltage signals.

As shown in FIG. 4, actuating the S3 button, step 1, has the micro controller 190 reduce the PWM signal to the off value (1/225), step 2, thereby to reduce the output voltage to the off level for as long as the switch is closed. When S3 is released, the PWM values are restored, step 6, to their pre-actuation value. Actuating the S1 button, step 4, causes the micro controller 190 to shift the PWM signal, step 5, to place a 3.0 volt positive DC offset voltage on the corresponding variable-voltage output channel to blow the whistle, without substantially changing the RMS AC output voltage, for as long as the S1 button is pressed. When button S1 is released, the PWM signal for the positive and negative half cycles of the AC signals are restored to be the same, step 6. Actuating the S2 button, step 7 causes the micro controller 190 to shift the PWM signal, step 8, to place a 2.0 volt negative DC offset voltage on the corresponding variable-voltage output channel without substantially changing the RMS output voltage for as long as the button is pressed. When S2 is released, the PWM values are restored, step 9, to their pre-actuation value. If the rms AC voltage VT1, VT2 is maintained within 0.5 to 1.0 volt of its value prior to actuation of S1 or S2, steps 4 and 7, then the effect on train engine performance is usually not apparent to the operator.

Actuating the S4 button, step 10, causes processor 190 to enter the programming mode, step 11, and changes the display 17 to indicate that the program mode has been activated. Otherwise, processor 190 continues, step 12. In the programming mode, step 11, the operator has several options depending upon the operating condition of station 5 when button S4 was actuated, step 13.

Generation of the aforementioned control signals is complicated by the fact that the typical modern electric train engine presents a non-linear load to station 5. For example, such engine contains diodes and capacitors to generate dc voltages for its microprocessor and other circuits. As a result, whereas station 5 generates sinusoidal signals at its outputs into linear (e.g. resistive) loads, the sinusoidal output signals tend to be distorted by the non-linear engine loads. Accordingly, while data processor 190 could create voltage offset by adding N counts, where N is an integer, to the PWM signal on one half cycle of the AC voltage, for example, the positive half cycle, and subtracting N counts from the PWM signal on the other half cycle of the AC voltage, for example, the negative half cycle, it is preferred to add N counts to the one half cycle and subtract M counts from the other half cycle. Typical values are:

| Function | Offset | N counts | M counts |
|---|---|---|---|
| Whistle | +3 V DC | +33 | −27 |
| Bell | −2 V DC | −18 | +22 |

Engine Programming—Options 50–52

Figure 5A:
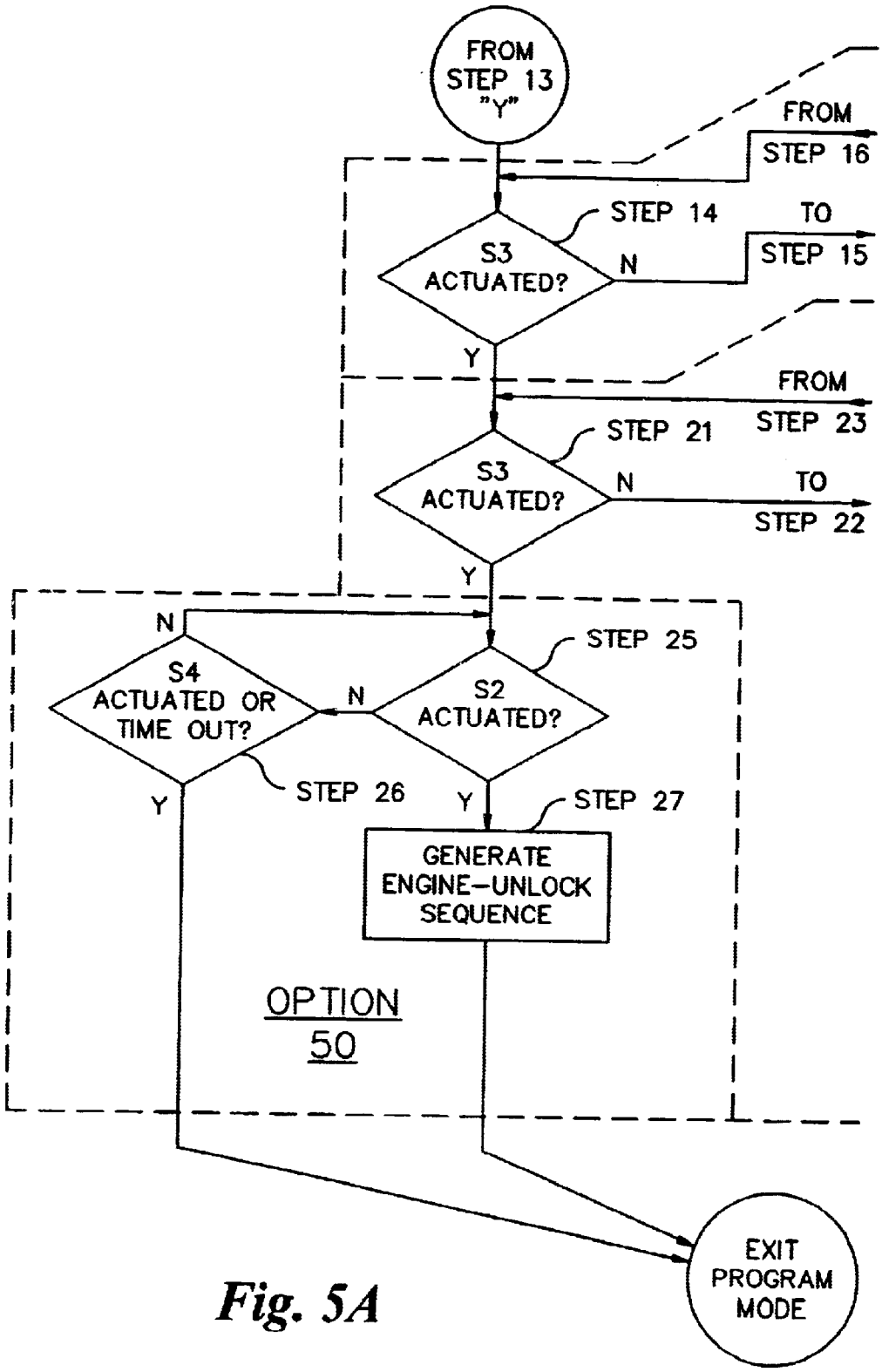
FIGS. 5 and 6 are logical flow diagrams relating to the operation of certain control functions of the control module portion of the embodiment of FIG. 2.
Figure 5B:
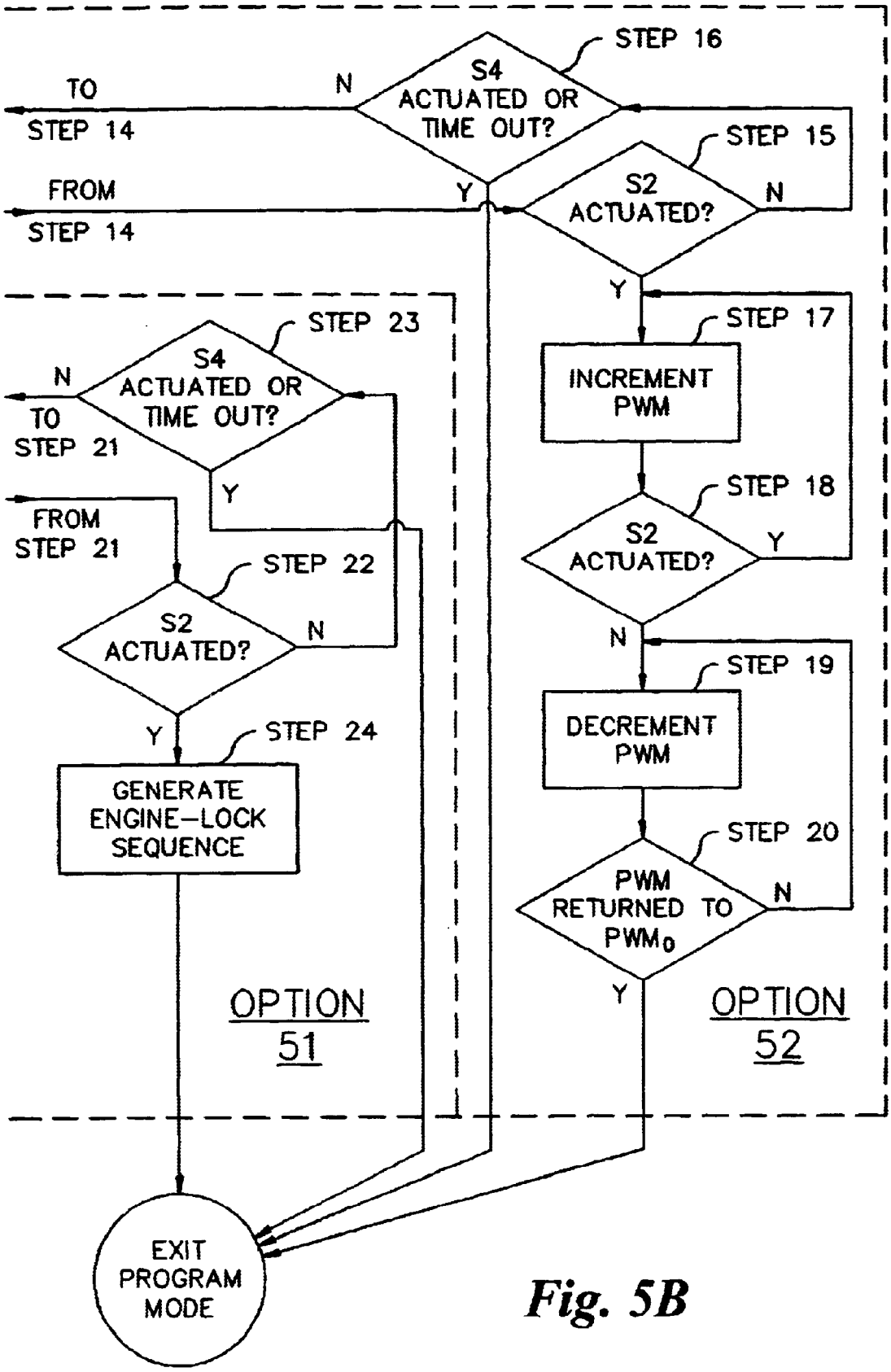

If TRACK 1 of station 5 is in the operating mode, i.e. if the variable-voltage output TRACK 1 voltage VT1 is above the turn-on threshold of about 5 volts, then three new features, known as options #52, #51 and #50, become available. Referring to FIG. 5, when S4 is actuated, step 11, processor 190 enters the program mode at option #52, and display 217 displays that number. Actuating button S3 once, step 14, decrements processor 190 to perform option # 51 and to cause display 17 to display the number 51, and actuating S3 a second time, step 21, decrements processor 190 to perform option #50 and to cause display 17 to display the number 50.

In option #52, power to the track, i.e. to an engine, may be gradually increased on a temporary basis, as may be desirable at times when the engine is climbing a grade, for example, when button S2 is actuated, step 15. In option #52, processor 190 increments, step 17, the PWM control signal at a rate of about 10 counts per second which causes drive circuit 50 to increment the variable-voltage VT1 to TRACK 1 at a rate of about 1 volt per second. When button S2 is released, step 18, processor 190 decrements, step 19, the PWM control signal at a rate of about 10 counts per second causing variable voltage VT1 to decrement at a rate of about 1 volt per second until the PWM count and therefore voltage VT1 have returned to the values that existed at the time button S2 was actuated, step 20. When the PWM count is returned to the pre-option #52 value PWM, processor 190 exits the program mode.

In option #51, an engine on TRACK 1 can be "locked" so that it does not respond to the voltage VT1 on the track. When button S2 is actuated in option #51, step 22, processor 190 generates, step 24, by sequencing the PWM count that controls TRACK 1 drive circuit 50, a sequence of output voltage VT1 that are detected by control circuits in the engine to lock the engine. For engines of the PREMIER and RailKing brands available from M.T.H. Electric Trains, of Columbia, Md., and for engines employing control circuits of the type commercially available from QS Industries of Beaverton, Oreg., a typical sequence is as follows:

Generate a +3 volt DC offset on VT1,

Reduce VT1 AC voltage to zero (to stop engine),

Hold VT1 at zero volts AC for the time necessary for the engine's control circuit to reset itself, for example, at least 3 seconds.

Upon completion of the sequence, step 24, processor 190 exits the program mode.

In option #50, an engine that is locked can be "unlocked" so that it again will respond to the voltage VT1 on the track. When button S2 is actuated in option #50, step 25, processor 190 generates, step 26, by sequencing the PWM count that controls TRACK 1 drive circuit 50, a sequence of output voltages that are detected by the aforementioned control circuits in the engine to unlock the engine. For engines of the aforementioned type, a typical sequence is as follows:

Generate a +3V DC offset voltage on VT1,

Reduce VT1 AC voltage to zero,

Remove the DC offset voltage on VT1,

Within a predetermined time insufficient for the engine's control circuit to reset itself, for example, 0.5 to 1.0 second, generate an AC voltage VT1, for example, 8V AC.

Upon completion of the sequence, step 27, processor 190 exits the program mode.

Processor 190 may be removed from the program mode by actuating button S4 while in the program mode or by the passage of a predetermined time, for example, about 35 seconds. This is accomplished in step 16 when in option #52, by step 23 when in option #50 and by step 26 when in option #50.

Engine Reset Option Selection—Options 1–47

Modern electric train engines include control circuits for controlling up to 47 different features or options, such as loudness and/or type of whistle or bell, engine sounds, crew or cargo sounds, lighting configurations, smoke, coupler control and so forth.

With prior art control stations, the operator selects the engine reset options by generating high-to-low or "high/low" transitions of the track voltage by cycling the control handles (the throttles) between a low level (e.g., 6V AC) and a high level (e.g., 16V AC). The operator must count how many times this is done, for example, forty times to access programming option #40. If the operator loses count or does not cycle the throttle controls correctly, he may select the wrong option number and may have to begin again begin again. If he cycles the throttles too many times, there is no way to go back; he must begin again. Needless to say, this programming method is extremely inconvenient as well as difficult to perform with the result that operators become discouraged and do not use engine features they paid for and desire. There is a need for a more direct and operator-friendly programming arrangement.

Figure 6:
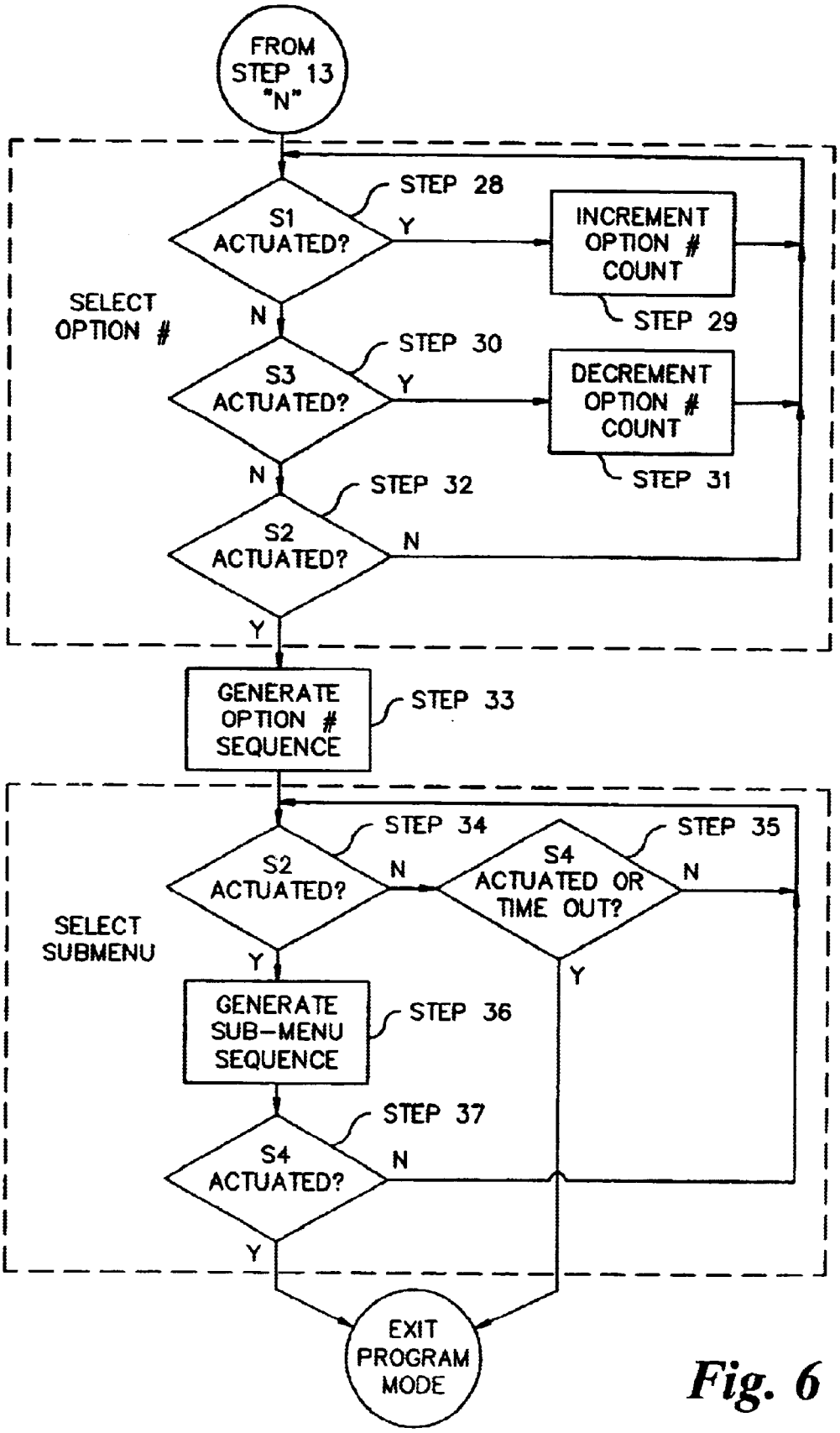

Referring now to FIG. 6, with both throttle controls 19*a*, 19*b* at their minimum position so that the variable-voltage outputs TRACK 1 and TRACK 2 are at a very low voltage VT1, VT2, actuation, steps 12 and 13, of button S4 causes processor 190 of section 5 to enter the program mode.

Actuating switch S1, step 28, increments, step 29, the count of the option number in processor 190 and causes display 17 to indicate to the operator the programmable Reset Option number then selected. Actuating switch S3, step 30, decrements, step 31, the count of the option number counter in processor 190 and causes display 17 to indicate to the operator the programmable Reset Option number then selected.

Once the operator has selected the desired Reset Option number, actuating switch S2, step 32, will cause processor 190 to generate, step 33, a sequence of signals to sequence the control circuit of the connected engine to this respective option channel as follows:

- Generate a standby track voltage VT1 of about 8V AC for about 5 seconds to allow the engine control circuit to prepare to accept option commands,
- Generate a sequence of AC track voltage VT1 changes or "high/low" pulses of equal number to the programmed option number selected, and
- Return to the standby track voltage VT1 and await sub-menu selections.

As processor 190 generates the sequence of PWM values to cause track drive circuit 50 to generate the number of high/low transitions of output track voltage VT1 shown on display 17, display 17 will show the counts increasing as the high/low VT1 signals are applied to the track. With the engine powered at about 8 volts, it is ready to receive control signals to program the sub-menu choice for the selected option number.

For the aforementioned engine control circuits, a high/low transition is applied starting with the output voltage VT1 of about 8 volts AC, then raising the output voltage VT1 to about 18 volts AC, and then returning the output voltage VT1 to about 8 volts AC. The engine control circuit "counts" a transition each time the AC voltage amplitude passes through 12.5 volts on the way down from 18 volts AC to 8 volts AC. (See waveform 910 of FIG. 9).

With the engine thus prepared to accept sub-menu programming commands, actuating S2 will then apply a positive DC offset voltage of about 3V DC to the output voltage VT1 allowing the operator to step through the sub-menu items of the selected programmable Reset Option. Each sub-menu typically has four selections stepped through by respectively applying DC offset voltage. Actuating S4 will then cause processor 190 and station 5 to exit the programming mode, and return the respective TRACK 1 or TRACK 2 output voltages to levels responsive to the respective throttle controls 19*a*, 19*b*.

Processor 190 of station 5 has a special sequence for Reset Option #27. If the processor 190 has generated 27 high/low signals and the throttles are above the turn-on threshold, for example, about 8V AC, and then S4 is again actuated, the engine control circuit will remain in the condition for manually stepping through Reset Option #27 sub-menu features.

Protection Functions

For the protection of persons and equipment, and the prevention of fires, limitation of the output voltages, currents and power that station 5 provides are necessary. Under UL standard 697, the limiting levels that cannot be exceeded for more than one minute are:

<30 volt AC rms voltage,

<30 Amperes AC rms current, and/or

<190 watts power.

Conventionally, output power has been limited by the internal impedance of the power-supplying device, but to so limit current and power to UL 697 levels would render the device inadequate to power a heavily loaded train engine under normal conditions. The problem is compounded if a station has plural outputs that must all meet the UL 697 standard both individually and when connected together.

It is for this reason that no plural output 190 watt control stations that meet present UL standards are presently made and most sold are refurbished older models that do not comply with present UL standards. It is the present invention that enables such control stations to be designed and manufactured in compliance with present UL standards.

Maximum Voltage Limiting

If the variable-voltage outputs TRACK 1 and TRACK 2 are lightly loaded (for example, only one engine is on the track and it is in reset or neutral), the output voltage VT1, VT2 can rise to about the open circuit voltage of the transformer 31, nominally 27–28V AC which exceeds the Three Rail Electrical Operating Specifications (TREOS) limit established by QSIndustries.

Data processor 190 monitors the TRACK 1 and TRACK 2 output voltages VT1 and VT2 as indicated by the outputs VSENS0 and VSENSI of voltage scaling element 150 continuously. Within seconds of detecting an rms value of VT1 or VT2 exceeding 21.5 V AC rms, processor 190 decrements the PWM value that controls the output having excessive voltage to cause track drive circuit 50 or 70, as the case may be, to reduce the excessive output voltage to 21.5 V AC rms.

Maximum Current Limiting

Maximum current limiting is a function provided by both the hardware of power module 15 and by the instruction set of processor 190 of control module 13 shown in FIG. 2. Over current sensing element 110 monitors the TRACK 1 and TRACK 2 output currents IT1 and IT2, respectively, as represented by the outputs ISENS0 and ISENS1 of current scaling element 170. If either current exceeds a predetermined threshold, for example, 20 amperes, element 110 removes the PWM signal from drive circuit logic element 90 and from drive circuits 50 and 70 for the remainder of that half cycle of the AC power from transformer 31 thereby to reduce the output current substantially to zero for that period of time. At the end of that half cycle, zero-crossing detector generates the interrupt pulse INTO that resets overcurrent sensing element 110 to again pass PWM signals to drive circuit logic element 90. This is the "hardware" current limiter.

Figure 7:
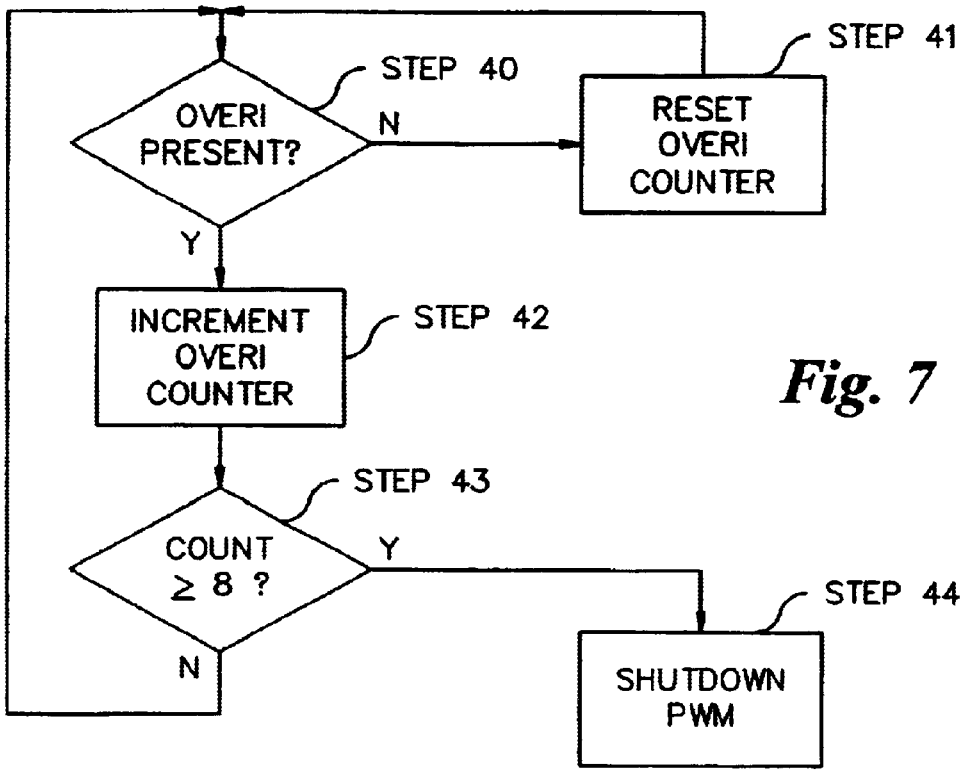
FIGS. 7 and 8 are logical flow diagrams relating to the operation of certain protection functions of the control module portion of the embodiment of FIG. 2.

Each time overcurrent sensing element 110 detects an overcurrent condition as just described, it generates and sends an over current signal OVERI to data processor 190. With reference to FIG. 7, processor 190 awaits the presence of overcurrent signal OVERI, step 40, and if it is not resent, processor 190 resets the OVERI counter, step 41, continues to test for its presence. When OVERI is received, step 40, processor 190 increments the OVERI counter, step 42.

If OVERI has been present for eight consecutive times, step 43, processor 190 shuts down station 5, step 44, by forcing the PWM signal to its minimum value (1/255) which causes the output voltages VT1 and VT2 to become substantially zero. Both control handles 19*a*, 19*b* must be brought to their respective zero or off positions to reset the station 5. If OVERI has been present for fewer than eight counts, step 43, processor 190 continues to test, step 40, for the presence of OVERI.

Maximum Power Limiting

Data processor 190 continuously monitors the output power for each variable-voltage output TRACK 1, TRACK 2 in conjunction with the calculations of rms voltage and current performed to update the voltage and current displays 17. If the power exceeds 180W for more than 5 seconds, processor 190 will decrement the PWM signal value for that output until the measured power for that output is reduced to a nominal 180 W.

This decrementing process is done slowly, over about 15 seconds, so as not to be functionally objectionable to the operator. If the output power of the output TRACK 1 or TRACK 2 being limited is not reduced to 180W within about 20 seconds, processor 190 sets the shut down signal BARRY to a low logic level so that the gate drive signals are removed from the power transistors Q1–Q2 of TRACK 1 and Q5–Q6 of TRACK 2 drive circuits 50 and 70, respectively, and TRACK voltages VT1, VT2 go to zero volts. To recover from this shutdown condition, processor 190 requires that the input power must be turned off and then back on.

Output Interconnect Shutdown

UL Standard 697 also requires that the output power (into an external load adjusted to achieve maximum power) must not exceed 190W with the output terminals interconnected in any possible combination. UL 697 allows one minute from the onset of the loading condition before measurement is made to determine whether the power exceeds the 190 watt limit, i.e. to reduce the power to under the specification limit.

There are two types of interconnection that can be significant with respect to the 190W limitation:

Variable-voltage Output to Variable-voltage Output connections,

Variable-voltage Output to Auxiliary Fixed-voltage Output connections.

Auxiliary Fixed-voltage Output to Auxiliary Fixed Output connections are not a concern here because both together cannot exceed 190W.

The detection of interconnections of outputs is complicated by three factors: First, there is a voltage transition point at about 12.5V AC on the track voltage which, if crossed from a higher to a lower voltage, can be interpreted by the engine as a high/low transition causing the engine to enter the programming state, which unintentional change to programming mode is not acceptable. Second, the Auxiliary fixed-output windings AUX1 and AUX2 have no measurement of voltage or current. Third, severe electrical noise is present on the track terminals when an engine is operating at moderate-to-high velocity, primarily due to erratic third rail roller electrical contact. As a result, there are 12 different possible interconnect test conditions, in addition to compensating for engine-generated electrical noise, to avoid a false or nuisance shutdown. Operation of the interconnect testing functions will be described with reference to FIG. 8.

Variable-Voltage Output Interconnect Test

Because the test for determining whether or not two variable-voltage outputs are connected together involves perturbating the variable output voltages VT1, VT2 generated by station 5 and involves considerable processing by processor 190, it is preferred to first screen the TRACK 1 and TRACK 2 outputs to determine if it is possible that they are interconnected and if so, is the total power within allowable limits.

To this end, the following screening tests are performed: step 50 tests the two output voltages VT1, VT2 for substantial equality which must be present if the TRACK 1 and TRACK 2 outputs are interconnected. If they are not equal within a predetermined tolerance, e.g. 3 counts at the A/D output, there is no interconnection and no problem, step 51. If the two voltages are substantially equal, then there is no problem, step 51, unless the output current IT1, IT2 of outputs TRACK 1, TRACK 2 are both in excess of a predetermined level, step 52, for example, 5 A rms. If both currents IT1 and IT2 exceed the predetermined level, then the interconnect test is run, step 54.

The test for interconnection, step 53, of two variable-voltage outputs is then performed by taking a reference set of voltage VT1, VT2 and current IT1, IT2 readings for both the TRACK 1 and TRACK 2 outputs. The voltage of the one output is then increased (or decreased), and a second set of readings VT1, VT2, IT1, IT2 is taken. The criteria to fail the test, step 54, can be deduced by noticing, that when interconnected the voltages at both output terminals must be the same value. If the voltage VT1 of the TRACK 1 output is commanded to increase, for example, we would expect the TRACK 1 current IT1 to increase. What is important to notice is that a TRACK 1 current IT1 increase will not only cause current to increase in the load (i.e. whatever is connected to the TRACK 1 output terminal), but that it will produce a decrease in the current IT2 of the TRACK 2 output only if the two outputs are interconnected.

Therefore, the criteria for determining if two variable-voltage outputs are connected together is to detect the current decreasing in the output whose output voltage was not commanded to increase. This variable output interconnect test is run periodically, for example, every three seconds, if the screening tests indicate the possibility of an interconnection being present.

To fail, step 54, the Variable-voltage Interconnect Test, step 53, and shut down the outputs, step 57, and thereby meet the UL697 requirement, the individual tests must be failed eight consecutive times, steps 55 and 56, (about 24 seconds total).

Auxiliary Fixed-Voltage Output Interconnect Test

Because station 5 has no measurement capability regarding the output voltages and currents of auxiliary outputs AUX1, AUX 2, interconnection thereof is determined by considering the effects of their source impedance. The variable-voltage outputs TRACK 1, TRACK 2 each have a source impedance of about 0.5 ohms, and the auxiliary outputs AUX1, AUX2 each have a source impedance of about 0.2 ohms.

Again, to avoid unnecessary track voltage perturbations and processor 190 processing, the following screening test, step 58, is first performed. By analysis, the UL 697 power limit will not be exceeded unless the variable-voltage output TRACK 1, TRACK 2 current exceeds 8A rms. Thus, the TRACK 1 and TRACK 2 output currents IT1, IT2 are tested, step 58, and if neither exceeds 8A, there is no problem, step 51.

If either IT1 or IT2 exceeds 8A rms, then an auxiliary output interconnect test, step 59, is run. If an interconnected variable-voltage output TRACK 1 or TRACK 2 is commanded to increase its output voltage VT1, VT2, and that output is interconnected with an auxiliary output AUX1, AUX2, the variable output voltage VT1, VT2 will not change in proportion to the value of the commanded voltage change because of the lower output impedance of the auxiliary output AUX1, AUX2 which will reduce the magnitude of the variable-voltage output VT1, VT2 change.

A criteria, developed from empirical measurements, detects the presence of an auxiliary output to variable-voltage output interconnection if the change in measured voltage VT1, VT2 from the starting voltage value is less than 7 A/D counts, a variable-voltage output is considered to be connected to an auxiliary output. This auxiliary interconnect test is run every three seconds if the current IT1, IT2 in either the left or right variable-voltage Output exceeds 8.0 A. In order to fail the auxiliary interconnect test, steps 59–60, and shut down the variable-voltage outputs TRACK 1, TRACK 2, eight consecutive test failures must be detected, steps 61–62.

If the test, step 59, is not failed, step 60, there is no problem, step 51. Each time the test is performed and failed, steps 59–60, the number of sequential failures are incremented in a counter, step 61. After eight consecutive failures, step 62, the PWM values for both outputs are reduced to the minimum value (1/225), step 57, thus reducing the output voltages to near zero volts. Status indicator 29 is turned on to notify the operator of station 5 of the shut down condition. To recover from an interconnect shutdown, both throttle controls 19*a*, 19*b* must be rotated to their minimum or off positions.

Interconnect Test Sequence

External factors render how the testing for interconnectedness of two or more outputs are conducted. Technically, any voltage perturbation that produces measurable test voltages and currents is satisfactory. Preferably, to avoid an operator perceiving voltage changes, the programming threshold level, for example, 12.5 V AC rms, must not be crossed and the voltage changes commanded should be small in amplitude and short in duration.

Figure 9:
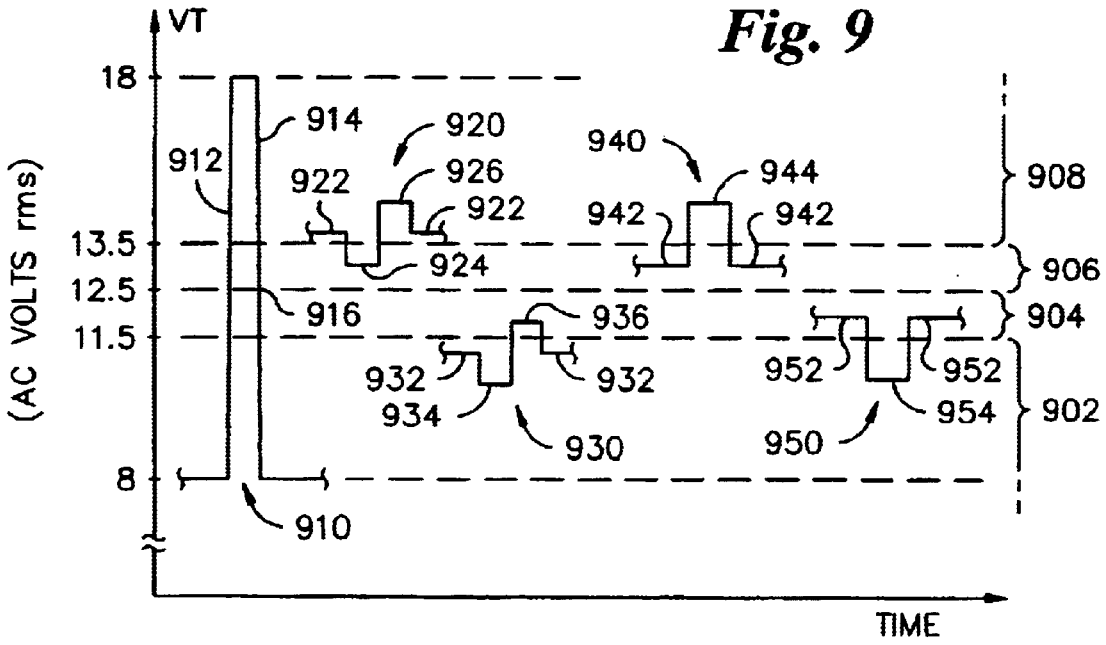
FIG. 9 is a graphical representation relating to the operation of the embodiment of FIG. 2.
Figure 8:
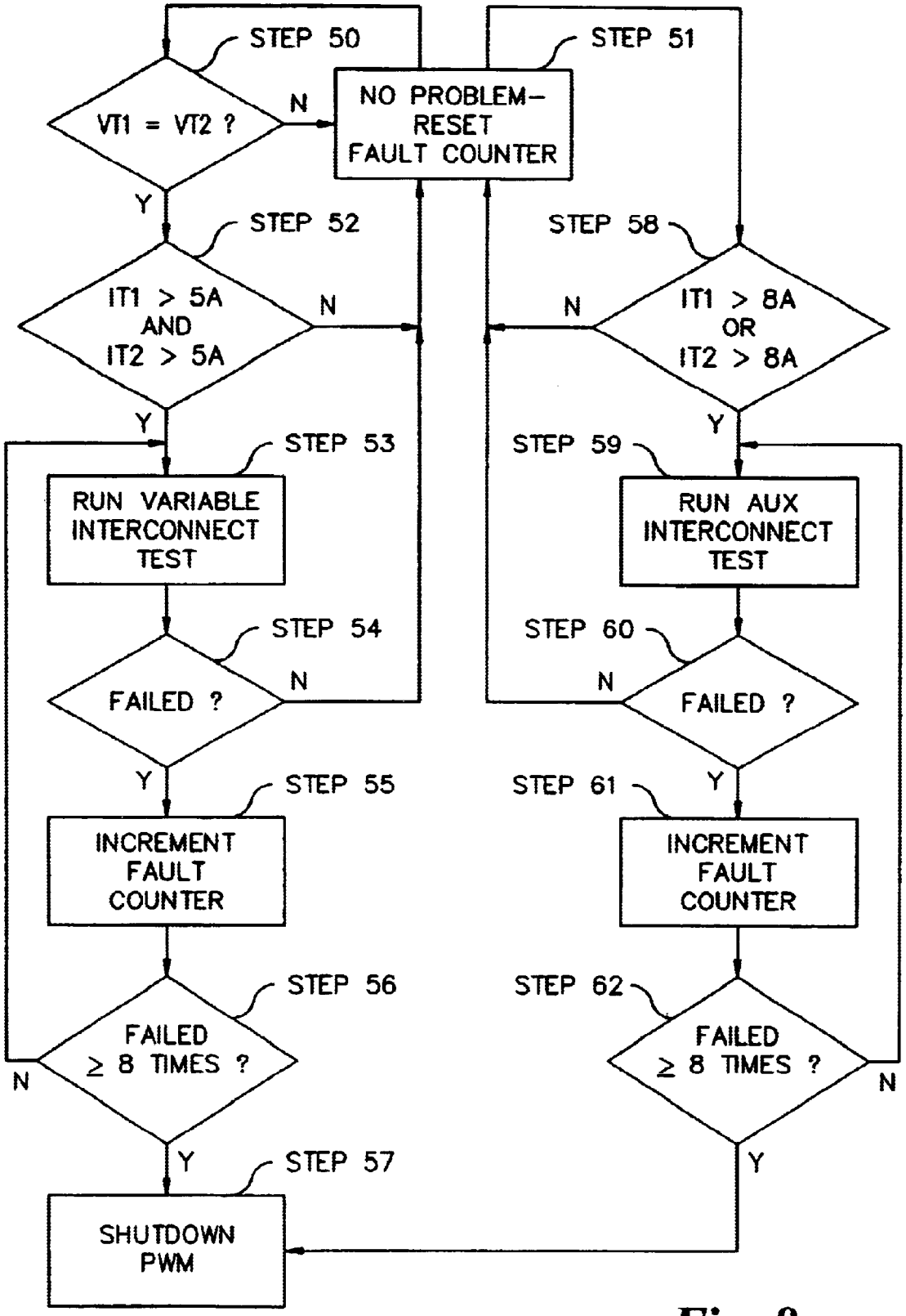

Referring to FIG. 9, a programming signal 910 is shown for reference. From an 8 V AC rms level, the track voltage VT amplitude is increased 912 to 18 VAC rms and then decreased 914 to 8 V AC rms. The control circuit in an engine detects a high/low transition when signal 910 decreases 914 through the 12.5 V AC rms value 916.

According to a preferred embodiment including the present invention, a guard band 904, 906 was created around the 12.5 volt high/low transition voltage, so that the interconnect test would not set an engine in reset into a programming mode. There are four zones 902, 904, 906, 908 in which interconnect tests are performed.

The first zone 902 is between startup voltage (nominally 5 volts) and 11.5 volts and waveform 930 represents the test sequence. In this zone the reference values VT1, V2, IT1, IT2 are taken and stored by processor 190 decreasing the commanded PWM value by 10 counts which is equivalent to about a 1 volt decrease in output voltage VT from level 932 to level 934. The PWM value is then increased by processor 190 by 20 counts to change VT from level 934 to level 936 and the measurement values VT1, VT2, IT1, IT2 are taken. The PWM value is then returned to the starting commanded PWM value restoring VT to level 932. The reference and measurement values are compared by processor 190 against the predetermined criteria for the particular test being performed.

The second zone 904 is between 11.5 volts and 12.5 volts and waveform 950 represents the test sequence. In zone 904, reference values are taken and stored with the commanded PWM count at its starting values where VT 1 is at level 952. The PWM value is then decreased by 20 counts changing VT from level 952 to level 954 and the measurement values are taken. The PWM value is then returned to the starting commanded PWM value so that VT returns to level 952. The reference and measurement values are compared by processor 190 against the predetermined criteria for the particular test being performed.

The third zone 906 is between 12.5 volts and 13.5 volts and wave form 940 represents the test sequence. In this zone 906, the reference values are taken and stored with the commanded PWM count at its starting value and VT at level 942. The PWM value is then increased by 20 counts causing VT to change from level 942 to level 944 and the measurement values are taken. The PWM value is then returned to the command PWM value and VT returns to level 942. The reference and measurement values are compared by processor 190 against the predetermined criteria for the particular test being performed.

The fourth zone 908 is between 13.5 volts and 22 volts and output voltage VT is at level 922. In this zone 908, the commanded PWM count is first decreased by 10 counts causing VT to change from level 922 to level 924 and the reference values are taken and stored by processor 190. The PWM value is then increased by 20 counts causing VT to increase to level 926 and the measurement values are taken. The PWM value is then returned to the starting commanded PWM value and VT returns to level 922. The reference and measurement values are then compared by processor 190 against the predetermined criteria for the particular test being performed.

In each of the foregoing test sequences, the PWM count remains at the changed level for two cycles of the input AC voltage, or about 33.33 milliseconds with a 60 Hz power source. It is noted that this is sufficiently short as to be difficult for an operator to perceive but is sufficiently long for processor 190 to reliably measure the appropriate voltages and currents. It is also noted that by changing the output voltage by 1 volt in one direction and then by 1 volt in the opposite direction, the deviation of the track voltage is only +1 volt which makes detection by the operator more difficult than it would be for a unidirectional 2 volt change.

Description of Preferred Circuits

Line Voltage Isolation Transformer 31

Figures 10, 11:
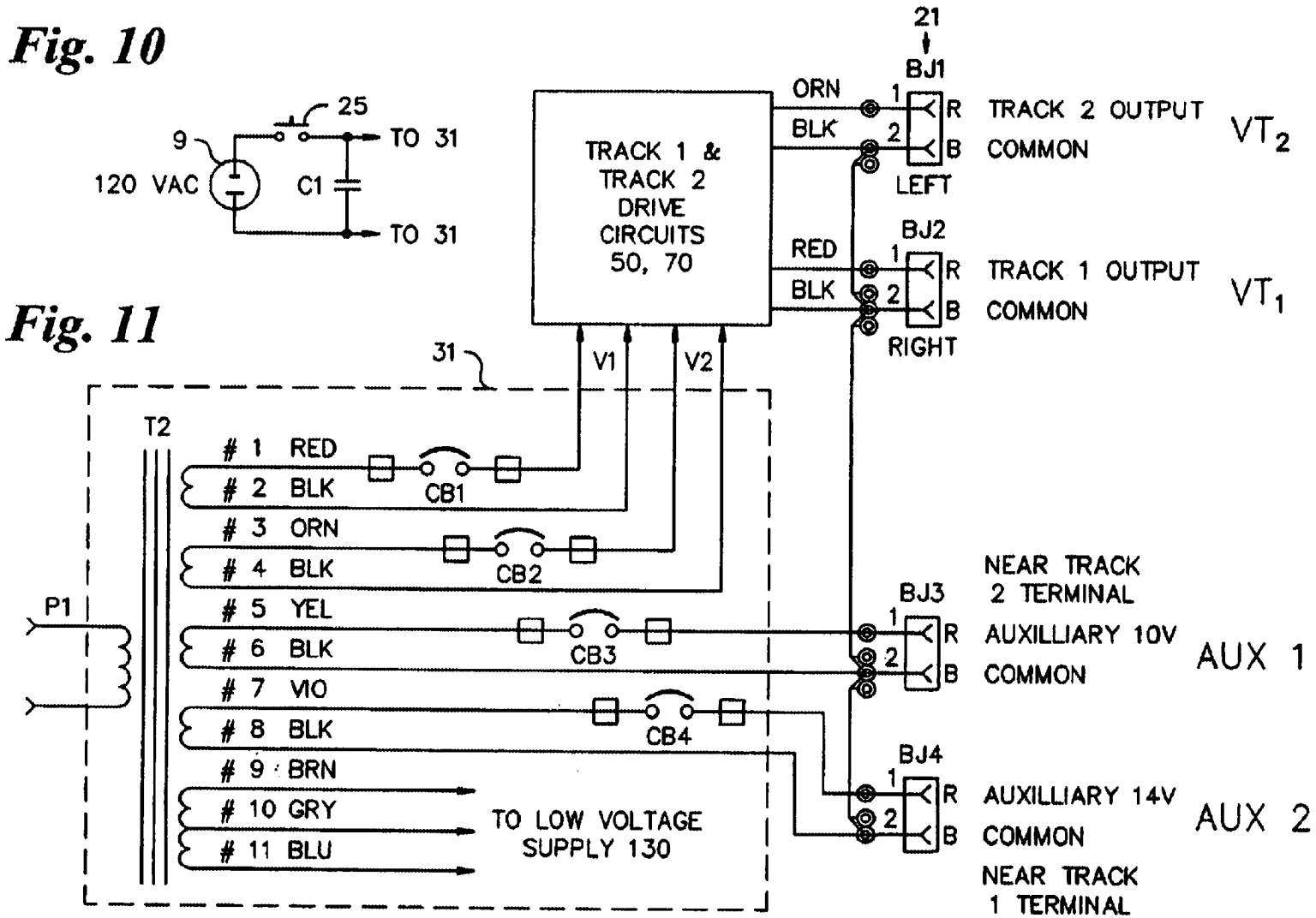
FIG. 10 is an electrical schematic diagram relating to the isolation transformer portion of the embodiment of FIG. 2.
FIG. 11 is an electrical schematic block diagram relating to a transformer and track drive circuit portions of the embodiment of FIG. 2.

Referring to FIG. 10, the line voltage isolation transformer 31 is shown for isolating the internal circuitry of station 5 from the AC line voltage. An 18-gauge two conductor UL type SPT-2 cord with polarized plug 9 connects a power source, for example, 120 v 60 Hz line current to isolation transformer 31. The polarized plug helps assure that if two or more stations 5 are used on a large track layout, the output voltages will be in phase. In addition, this assures that the customer cannot interconnect the output terminals of two stations 5 and get more than 30V AC, thus exceeding the UL maximum voltage requirement, without plugging the two stations into two different electrical supplies. The station 5 is turned on and off by a power switch 25 on the line side of the transformer 31.

Transformer 31 and the 110V AC connections are housed within an enclosure to protect persons repairing station 5 from the shock hazards of the primary leads of transformer T1. Thus, operators must disassemble station 5 and must further disassemble a protective shield therein in order to create the possibility of electric shock.

Filter capacitor C1, connected across the power line reacts, with the leakage inductance and low capacitance of the split-bobbin wound transformer 31 to form a filter to keep switching noise from the power module 15 and control module 13 from being conducted to the power line 9.

Referring now to FIG. 11, transformer circuit 31 provides power for the outputs of station 5, namely variable-voltage outputs TRACK 1 and TRACK 2 and fixed-voltage outputs AUX 1 and AUX 2.

Transformer T2 windings 5–6 and 7–8 have direct connections through circuit brakers CB3 and CB4, respectively, to fixed outputs AUX 1 and AUX 2. The output terminals 21 may be dual binding post banana type connectors BJ1–BJ4. Circuit breakers CB1–CB2 protect the power switching circuits from fire in the event of failure of drive circuit 50 or 70. Transformer 31 windings 1–2 and 3–4 are coupled through circuit breakers CB1 and CB2, respectively, to provide AC voltages V1 and V2 from which the variable-voltage outputs TRACK 1 and TRACK 2 are generated. Winding 9–10–11 is connected to provide AC voltage to low voltage power supply 130.

Power Module 15

Power module 15 will be described in relation to FIGS. 12–16.

TRACK 1 Drive Circuit 50

Figure 12A:
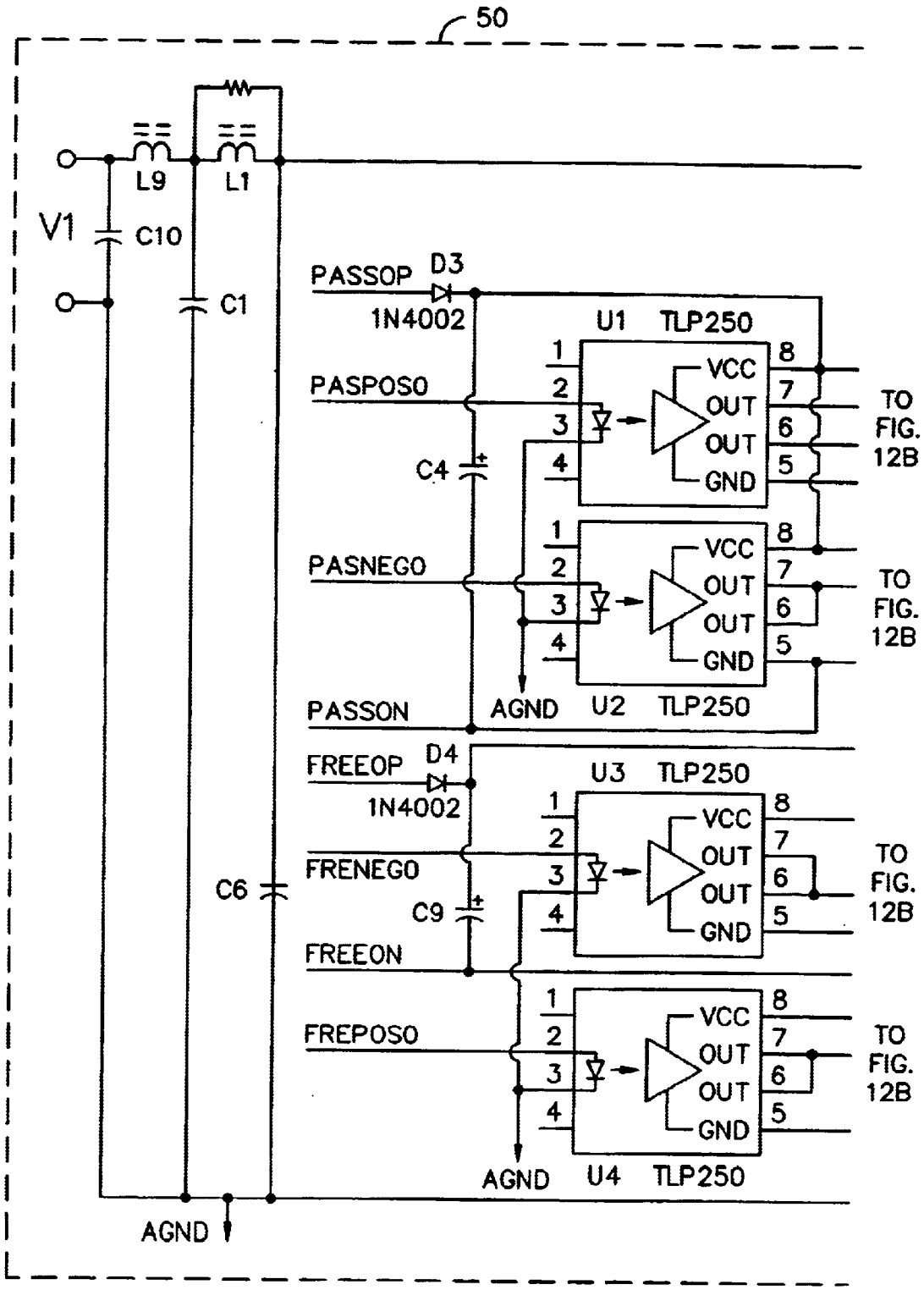
FIG. 12 is an electrical schematic diagram relating to a track drive circuit portion of the embodiment of FIG. 2.
Figure 12B:
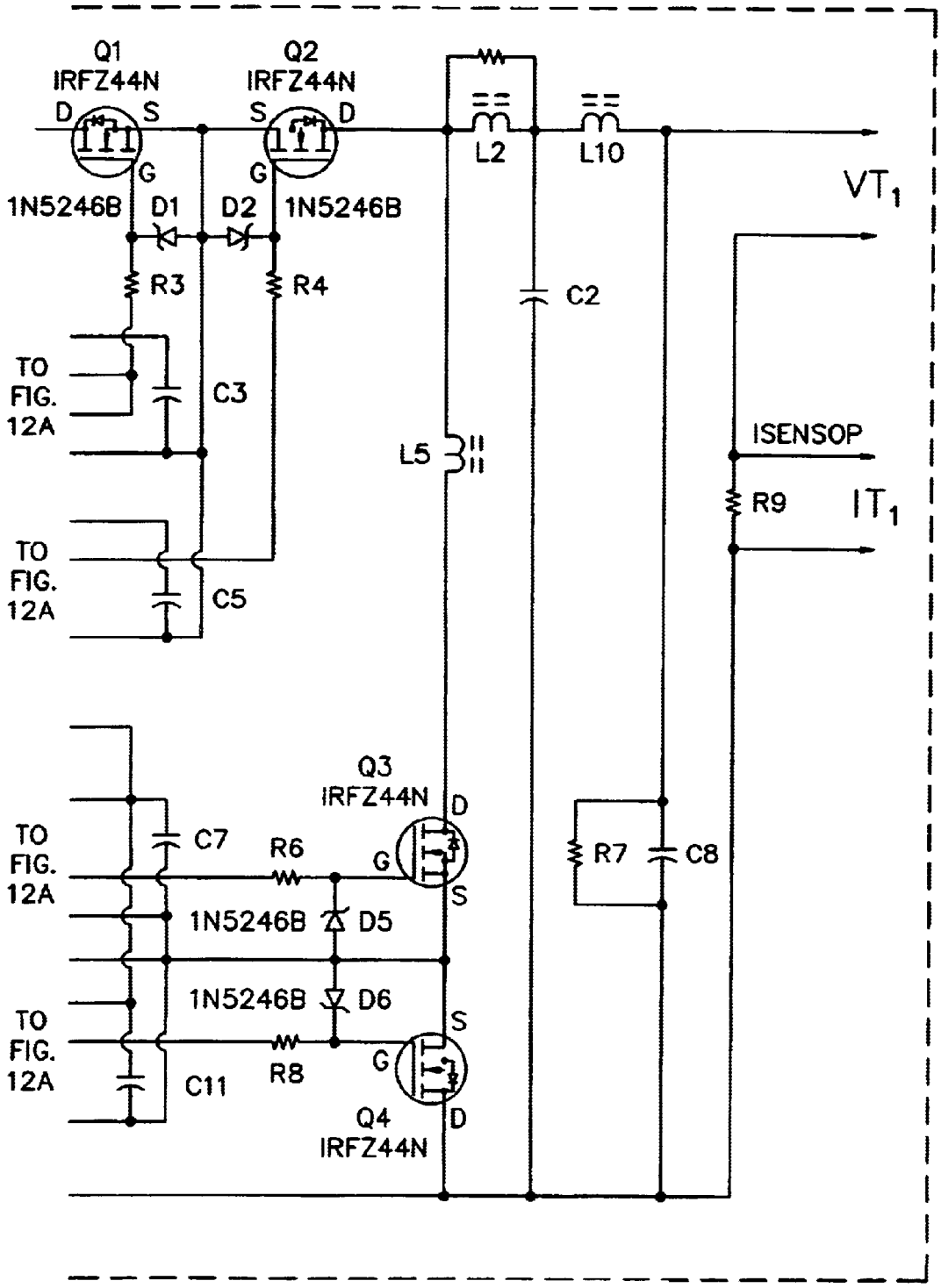

Referring now more particularly to FIG. 12, Track 1 drive circuit 50 of power module 15 is a scaling circuit responsive to a control signal to control the output amplitude of the variable-voltage output TRACK 1 channel of station 5. The AC output voltage VT1 amplitude is proportional to the input voltage V1 times the pulse width modulation (PWM) duty cycle. The PWM duty cycle is controlled in response to drive signals PASPOS0, PASNEG0, FREPOS0 and FRENEG0 generated by gate drive circuit 90 in response to control module 13. The PWM duty cycle during the positive and negative half cycles of the AC signal V1 at the output of amplifier drive circuit 50 may be independently controlled by the aforementioned control signals in response to control module 13. Thus, increasing the duty cycle during the positive half cycle of the AC input voltage and decreasing the duty cycle during the negative half cycle thereof generates a positive DC offset voltage on which the AC voltage is superimposed, thereby to generate a Horn/Whistle signal in the TRACK 1 output, while keeping the rms value of the AC output voltage constant. Likewise, increasing the PWM duty cycle during the negative half cycle of the AC input voltage and decreasing the PWM duty cycle during positive half cycle thereof generates a negative DC offset to generate a train control signal, such as a bell signal, while keeping the rms value of the AC output voltage constant. This feature allows the engine speed to remain substantially constant while the horn, bell or other features are activated.

The power circuit configuration formed by Q1/Q2, Q3/Q4, L2 and C2 in FIG. 12 is a "Buck" converter, adapted to be operated bidirectionally with an AC input voltage. The output voltage is proportionate to the PWM duty cycle times the AC input voltage, and is not regulated so as to simulate the performance of conventional model train transformers.

Referring more particularly to FIG. 12, one main winding of transformer circuit 31 provides 27V AC for connection to an input inductor L9. Inductor L9 is wound on a powdered iron core and, at higher currents, its inductance decreases. Together with capacitors C1, C6, C10, Inductor L8 and L9 form a filter network to reduce the switching signal from drive circuit 50 that is applied to transformer circuit 31. Preferably C10 is a polypropylene capacitor to assure low ESR. Inductor L1 and capacitor C1 provide a high frequency filter so that the high frequency components not effectively filtered by the L0–C10 filter are not coupled to the transformer 31 and thence to the power line. Additionally, capacitor C6 provides a path for current flowing in inductor L9 when power transistors Q1, Q2 are switched off. Thus, components L1, C1, L9, C10, C6, along with the split-bobbin construction of the power transformer 31, allow station 5 to comply with Federal Communications Commission (FCC) conducted emissions regulations.

Power field-effect transistors (FETs) Q1–Q1, inductor L10 and capacitor C8 form a "buck-type" pulse width modulated (PWM) switching converter circuit that is adapted to operate with an input voltage of either polarity and thus AC voltage V1. For a buck-type converter $$V_{out} = d\ V_{in}$$

Where:

"Vout" is the output voltage (i.e. VT1),

"Vin" is the input voltage (i.e. V1), and

"d" is the duty cycle, i.e. the ratio of the on-time to the period of the PWM signal In the buck-type converter of FIG. 12, FET Q1 is the switching transistor that pulse-width modulates input voltage V1 and FET Q3 serves as the commutating or "free-wheeling" diode during the positive half cycle of input AC voltage V1. On the negative half cycle thereof, FET Q2 is the switching transistor and FET Q4 serves as the free-wheeling diode. The resonant frequency of the L10-C8 filter is selected to be above the 60 Hz frequency of V1 so that a 60 Hz output signal VT1 can be generated, but is much lower than the PWM frequency so that it substantially reduces the AC-signal component at the PWM frequency.

During the input AC voltage V1 positive half cycle, the transistors Q2 and Q4 are switched on and the transistor Q1 is switched or toggled at the PWM 28.9 Khz frequency. FET Q3 is switched off for the entire positive half cycle so that the substrate diode in transistor Q3 can act as the free wheeling diode to complete the buck converter circuit topology. Similarly, on the negative half cycle of input voltage Vi, FETs Q1 and Q3 are turned on, FET Q4 is turned off so its substrate diode serves as the free-wheeling diode, and FET Q2 is switched at the PWM frequency. Preferably, FETs Q1–Q4 are of type IRFZ44N available commercially from International Rectifier Corporation. The function performed by the substrate diodes of FETs Q1–Q4 as described herein may also be performed by connecting electronic diodes between the drain (d) and source(s) terminals of alternative types of FETs or other switching device.

The gate drive signals PASPOS0 and PASNEG0 are coupled to power field-effect transistors (FETs) Q1 and Q2 by the opto-coupler gate drivers U1 and U2, respectively. U1, U2, U3, U4 are powered by floating DC power supplies created by diodes D3, D4 and capacitors C4, C9 in response to AC voltages derived from a transformer in the low voltage power supply 130. Similarly, opto-couplers U3 and U4 couple gate drive signals FRENEG0 and FREPOS0 to FETs Q3 and Q4, respectively. These floating supplies allow the power FET switching transistors Q1, Q2, Q3, Q4 to be switched on and off at any point on the positive and negative half cycles of input voltage V1.

Inductor, L5 controls the turn-off voltage high frequency ringing at the Q2-L5 node, and inductor L2 and capacitor C2 form a filter, so that the station 5 can meet FCC requirements.

Capacitors C2 and C8 are polypropylene capacitors to assure low ESR and inductor L10 has a powdered iron core. Since L10 has high shunt capacitance it cannot effectively filter the high frequency components from the transistor switching of TRACK 2 drive circuit 50. Inductor L2 and capacitor C2 provide a high frequency filter to reduce the high frequency components coupled to the output terminals.

Because output capacitor C8 will tend to charge up to a voltage greater than dV1 when the output VT1 is not loaded, resister R7 provides a minimum load to limit the voltage on C8 to about 0.6 V AC with the minimum PWM duty cycle of 1/255.

Even at minimum track loading, such as a "lighted lock-on" device, further reduces the lightly loaded output voltage VT1. With a single engine on the track the output voltage VT1 is reduced to about 0.2 V AC at minimum PWM duty cycle (1/255). This is well below the TREOS 1.9 v peak specification for determining a track-voltage Off state. In practice, the track voltage VT1 must be reduced to below about 0.8 volt for all engines to reliably detect an Off state.

Resistor R9 senses the output current IT1 from TRACK 1 drive circuit 50 for use by the scaling circuit 150.

Overcurrent Sensing Circuit 110

Figure 13A:
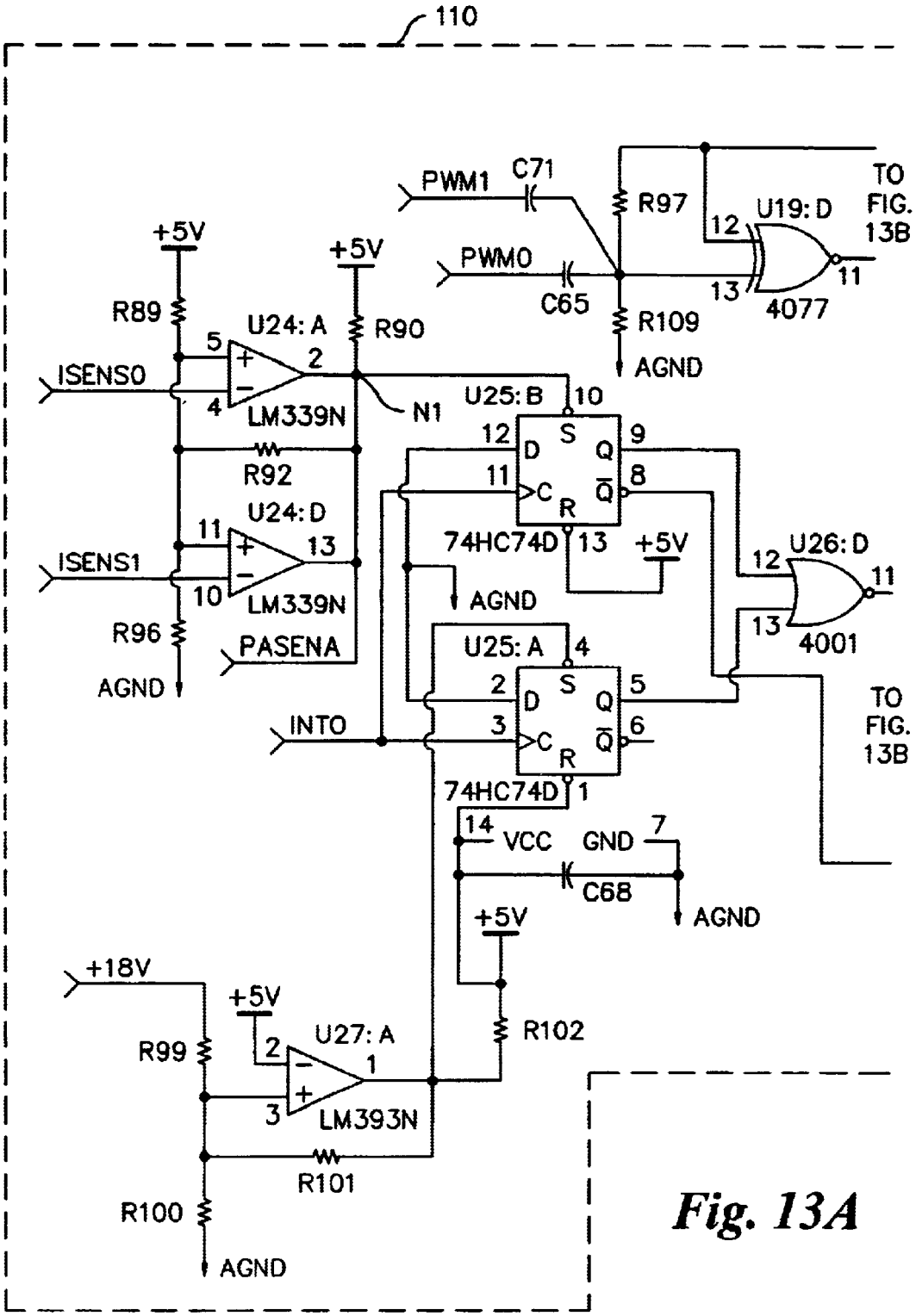
FIG. 13 is an electrical schematic diagram relating to an overcurrent sensing element portion of the embodiment of FIG. 2.
Figure 13B:
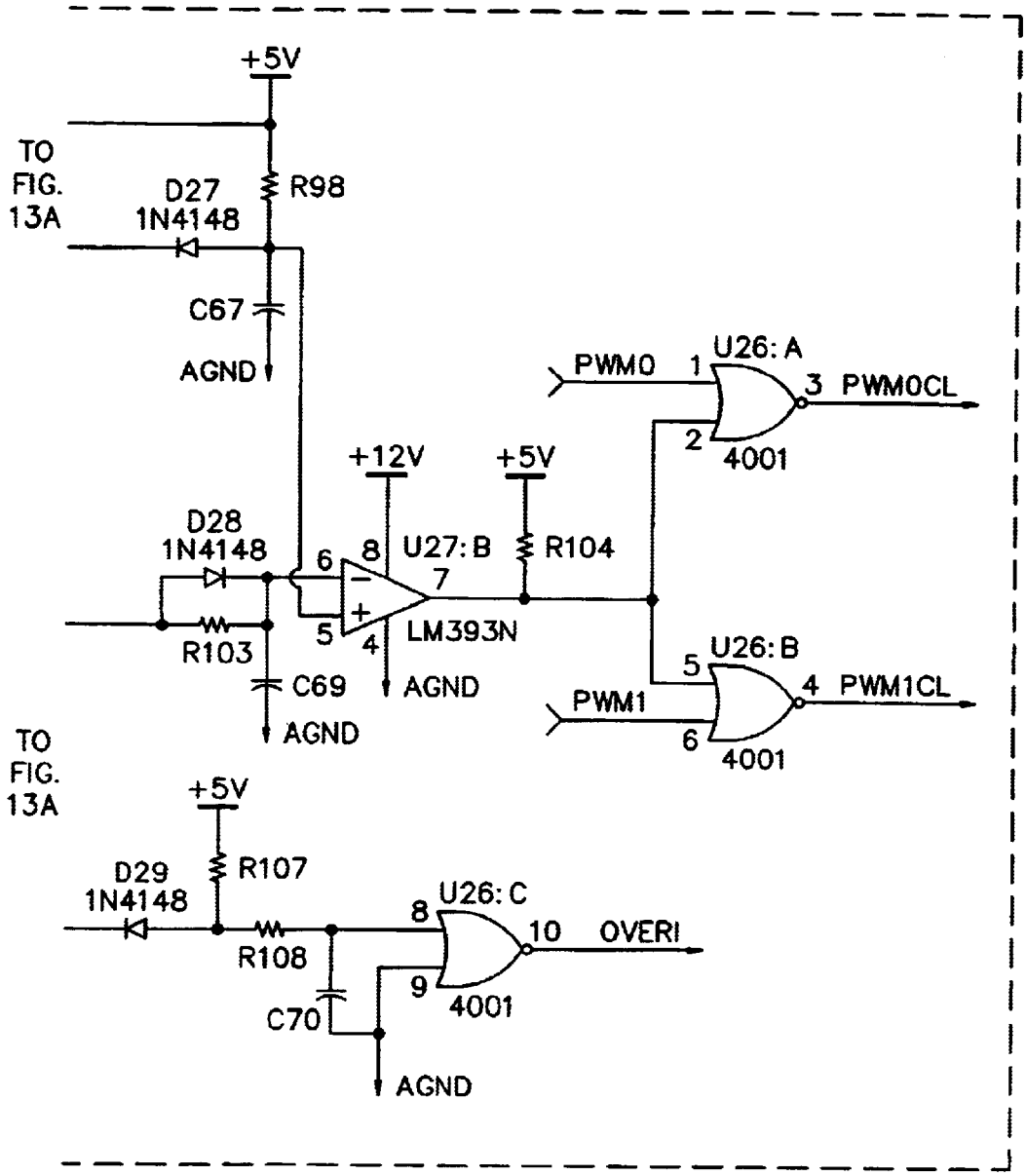

Referring now to FIG. 13, overcurrent sensing circuit 110 of power module 15 includes comparators or operational amplifiers (Op-amp) U24, U27, Flip-Flops U25, and logic packages U19, U26. Overcurrent sensing circuit 110 monitors the current output and undervoltage conditions of station 5.

Operational amplifiers U24A and U24D preferably of type LM339, sense the respective output currents IT1 and IT2 of the TRACK 1 and TRACK 2 outputs by way of the scaling amplifiers and full-wave rectifier of current scaling circuit 170 of power module 15. When the peak value of either of the current representative signals ISENS0 or ISENS1 reaches 5.0 volts, the output of comparator U24A or U24D at node N1 changes to logic low. This sets the Q output of flip flop U25B, preferably of type 74HC74D, to a logic high which causes the output of OR gate U26D, preferably of type CD4001, to change to logic low and begin discharging capacitor C69 through resistor R103. Similarly, the shut down signal PASENA from control module 13 pulls node N1 low to initiate discharging capacitor C69.

The non-inverting (+) unput of comparator U27B, preferably of type LM393N, receives a ramp signal that is synchronized with the negative-going transition of the PWM signal inputs to exclusive NOR gate U19D supplied by the control module 13, namely the PWM0 and PWM1 signals. The result of comparing the relatively slow exponential signal on the inverting (−) input of U27B with the relatively faster exponential signal on the non-inverting (+) input of U27B is to gradually reduce the duty cycles of the PWM1 and PWM0 signals passed by NOR gates U26A and U26B from their commanded value to zero over a predetermined period of time.

This gradual reduction of the duty cycle of the PWM signals provides a "soft-stop" current limiting that allows time for the energy stored in the filter inductors L9, L10 of TRACK 1 drive circuit 50 (and the corresponding inductors of TRACK 2 drive circuit 70) to safely dissipate in the load, thus preventing the voltage across capacitor C6 and FETs Q1–Q4 of the TRACK 1 drive circuit 50 (and corresponding devices of TRACK 1 drive circuit 70) from reaching excessively high values.

At the instant of sensing an over-current condition the Q* output of flip flop U25B, U25B begins to discharge capacitor C70 through resistor R108. After several power line cycles of sustained over-current indication, the output of U26C changes to logic high to generate signal OVERI that informs data processor 190 that an overcurrent condition has been detected. The delay caused by resistor R108 and capacitor C70 in signaling the processor 190 allows for ignoring short term intermittent track shorts, such as may be caused by dragging couplers and conductive debris, and reduces nuisance shut downs. Data processor 190 control module 13 initiates a software timer which monitors the overcurrent condition for a period of time. If the overcurrent condition exists for longer than the predetermined time, e.g., as indicated by its existence at eight consecutive observations, control module 13 sets the PWM signals PWM0 and PWM1 for both the TRACK 1 and TRACK 2 channels to minimum, thus reducing the output voltages VT1 and VT2 to near zero volts.

Comparator U27A compares the voltage on an unregulated low-voltage positive DC supply (+18V) from low voltage power supply 130 to the regulated +5 V DC supply voltage. If the unregulated voltage drops below about 13 volts, the output of comparator U27A becomes a logic low that sets the output Q of flip flop U25A to logic high and begins the current limiting "Soft-Stop" process as described above.

The interrupt signal INTO from zero crossing detector 140 resets flip flops U25A and U25B at each zero crossing of the input AC voltage sinewave. The shutdown process is therefore re-enabled for every half cycle of the input AC voltage signal.

Drive Circuit Logic 90

Figure 14:
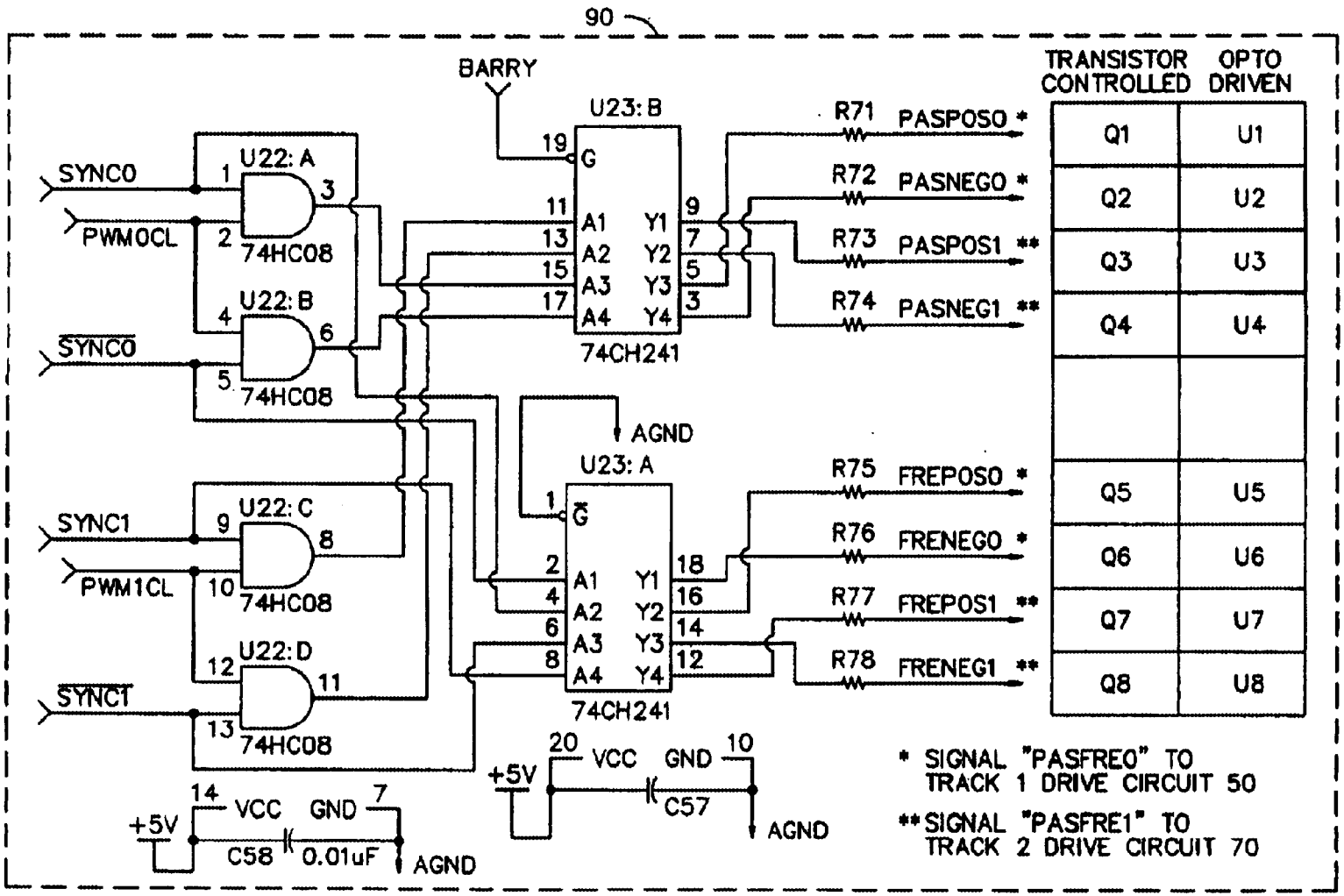
FIG. 14 is an electrical schematic diagram relating to a drive circuit logic element portion of the embodiment of FIG. 2.

Referring now to FIG. 14, logic drive circuit 90 of power module 15 includes logic gate package U22 preferably of type 74HC08 and buffer-driver logic package U23 preferably of type 74HC241. Logic drive circuit 90 provides PWM drive signals PASFRE0 and PASFRE1 to the opto-coupler drivers U1–U4 of the TRACK 1 and TRACK 2 drive circuits, 50 and 70, respectively.

Logic drive circuit 90 processes the synchronization (SYNC) signals SYNC0, SYNC1, (and their inversions of like name indicated by an overscore) generated by zero crossing detector 140. The table at the output side of the circuit (right side of FIG. 14) shows the relationships of the opto-coupler drivers to the power transistors of TRACK 1 and TRACK 2 drive circuits 50 and 70. Quad AND gates of U22 are driven high by the presence of the various SYNC signals and their inversions, and its corresponding PWM update signal PWM0CL, PWM1CL from control module 13 as modified by overcurrent sensing circuit 110 as described above.

Drivers U23A and U23B provide sufficient PWM drive signals PASFRE0 (i.e. PASPOS0, PASNEG0, FREPOS0 and FRENEG0) to TRACK 1 drive circuit 50 and sufficient PWM drive signals PASFRE1 (i.e. PASPOS1, PASNEG1, FREPOS1 and FRENEG1) to TRACK 2 drive circuit 70.

Buffer driver U23B receives operating voltage from the signal BARRY being a logic high. Upon an over power condition not corrected by the power limiting loop of processor 190, processor 190 takes signal BARRY to a logic low thereby to turn off the FET switch Q1 of drive circuit 50 (and the corresponding switch of drive circuit 70) and reduce the track voltages VT1, VT2 to zero.

Voltage Scaling Circuit

Figure 15:
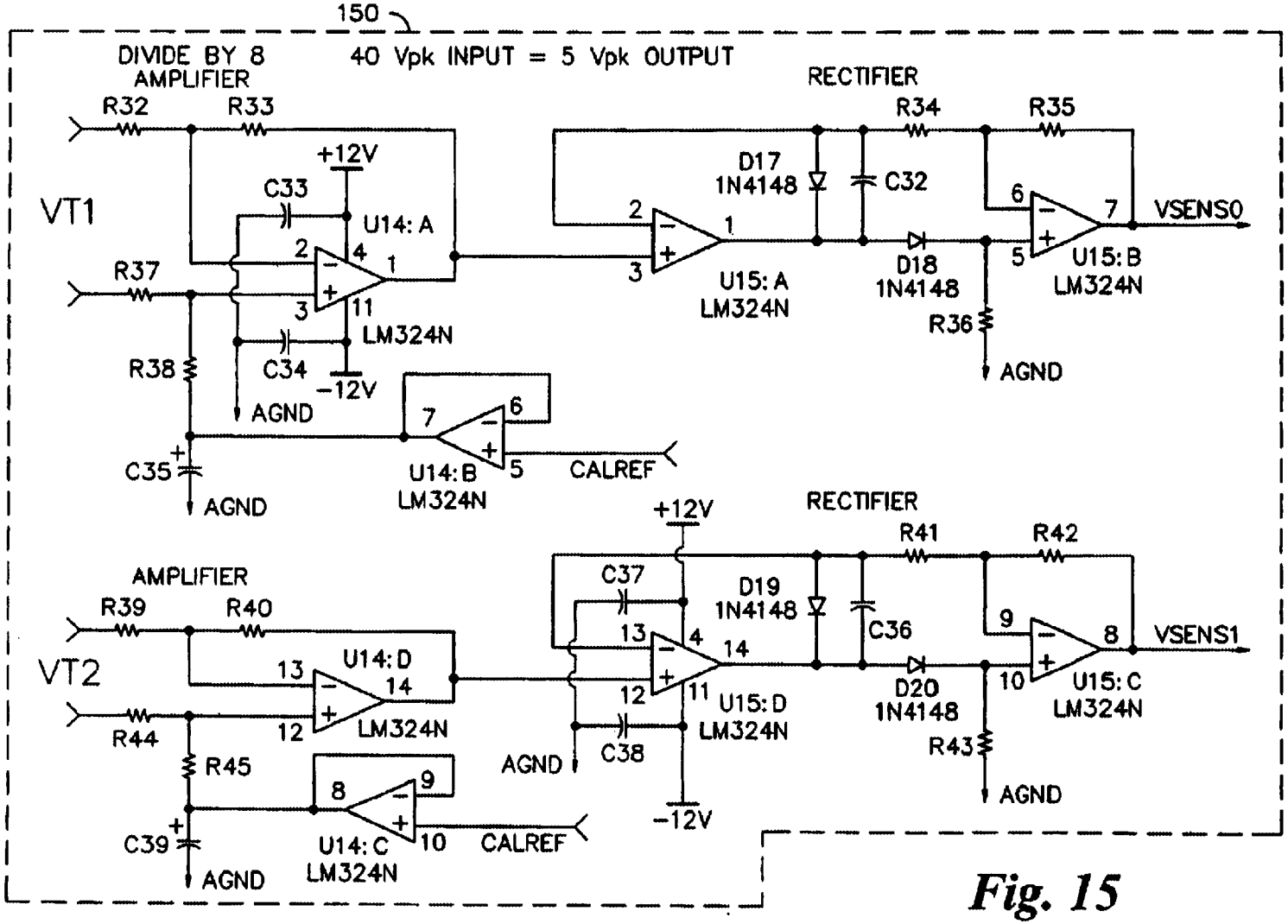
FIG. 15 is an electrical schematic diagram relating to a voltage scaling element portion of the embodiment of FIG. 2.

Referring now to FIG. 15, voltage scaling circuit 150 of power module 15 includes Quad Op-amp packages U14 and U15, preferably of type LM324N, rectifier diodes D17–D20 and associated resistors and capacitors. Voltage scaling circuit 150 scales and full-wave rectifies the analog measurements of the variable-voltage outputs VT1, VT2 of TRACK 1 and TRACK 2 of power module 15 for processing by the control module 13.

Amplifier U14A divides the TRACK 1 variable output voltage VT1 by the values of resistor ratios R33/R32, and R38/R37, for example, by 8. Amplifier U14B provides a reference voltage for the measurement, specifically for the offset calibration CALREF.

Amplifiers U15A and U15B and diodes D17–D18 form an active full-wave rectifier which converts the scaled signals from U14A to a full-wave rectified signal that can be applied to the A/D converter 210 in the control module 13.

Amplifiers U14D, U14C, U15D and U15C perform like scaling and rectification of the TRACK 2 variable output voltage VT2. Under normal operation the signals VSENS0 and VSENSI will not exceed a peak value of 5.0 volts (the full scale input voltage of the A/D converter 210) which corresponds to TRACK 1 and TRACK 2 peak voltages of 40 volts.

Current Scaling Circuit

Figure 16:
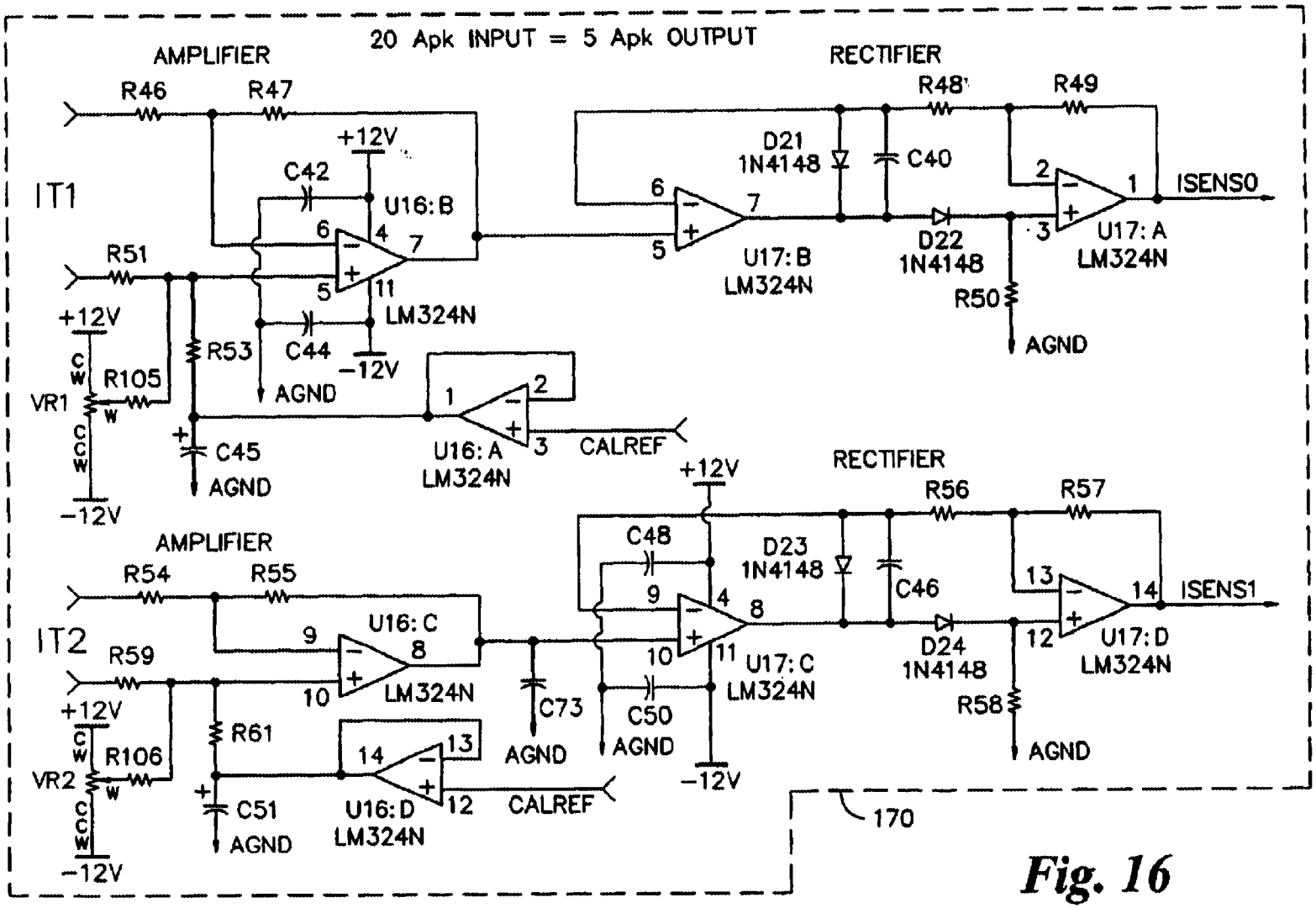
FIG. 16 is an electrical schematic diagram relating to a current scaling element portion of the embodiment of FIG. 2.

Referring now to FIG. 16, current scaling circuit 170 of power module 15 includes Quad Op-amp packages U16 and U17, preferably of type LM324N, rectifier diodes D21–D24 and associated resistors and comparators. Current scaling circuit 170 amplifies the respective analog current signals IT1, IT2 of variable-voltage outputs TRACK 1 and TRACK 2 of the power module 15 for processing by the control module 13.

Amplifier U16B amplifies the current induced voltage across a current sensing resistor R9 of TRACK 1 drive circuit 50 of power module 15 by the ratio of resistors R47/R46 and R53/R51, for example, by a factor of 25. Amplifier U16A provides a reference voltage for the measurement, specifically the offset calibration voltage CALREF.

Amplifiers U17A and U17B and diodes D21–22 form an active full-wave rectifier which converts the scaled current signal from U16B to a full-wave rectified signal that can be applied to the A/D converter 210 in the control module 13. Amplifiers U16C, U16D and U17D perform like amplification and rectification of the TRACK 2 output current signal IT2. Under normal operation the signals ISENS0 and ISENS1 will not exceed a peak value of 5.0 volts (the full scale input voltage of the A/D converter 210) which correspond to peak TRACK 1 and TRACK 2 currents of 20 A.

Watch Dog Circuit 290

Figure 17:
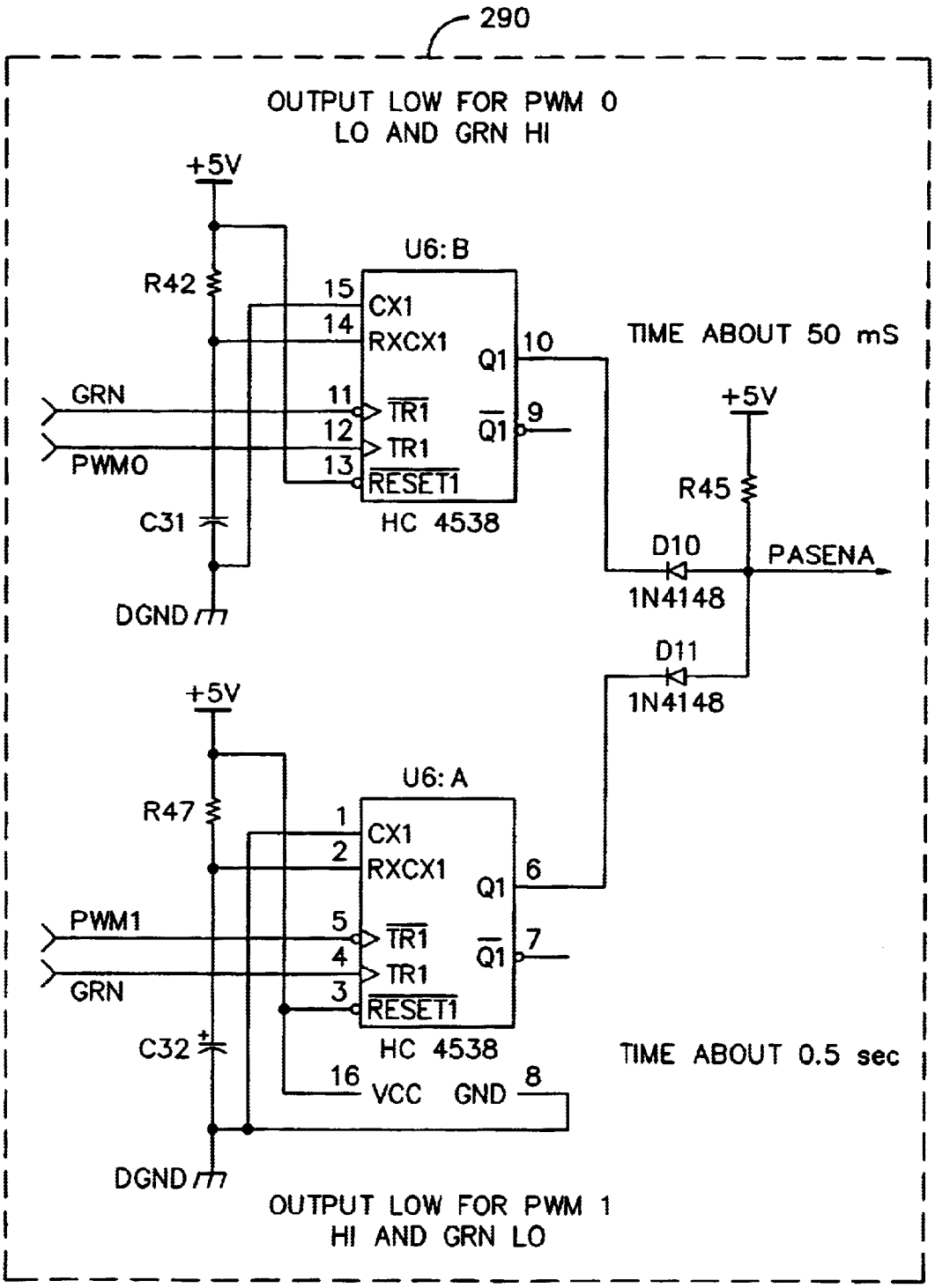
FIG. 17 is an electrical schematic diagram relating to a watchdog circuit portion of the embodiment of FIG. 2.

Referring now to FIG. 17, watchdog circuit 290 of control module 13 includes a dual retriggerable monostable multivibrator U6, preferably of type 74 HC4538. Watchdog circuit 290 monitors the operation of data processor 190 so as to enable station 5 to comply with UL Standard 697 under a single component failure condition.

Processor 190 executes a main loop program and interrupts. Interrupts generated at each zero-crossing of the input AC waveform V1 are employed to set new PWM values generated by the instruction set of processor 190 into a PWM register and then the PWM signals are generated by electronic hardware. Thus, power module 15 will continue to run at the most recent PWM value even if processor 190 were to fail. Because all monitoring and testing functions performed by processor 190 are executed in the main-loop functions, cessation of main-loop function may mean that station 5 might not react to conditions prohibited by UL Standard 697 if the main loop were to fail. If processor 190 is operating it must be generating PWM signals and a changing signal GRN.

Each half of U6 is connected as an edge-triggered retriggerable one shot that is retriggered so long as data processor circuit 190 is operating. U6B is retriggered each time the control line GRN from the data processor 190 is logic High and PWM signal PWM0 transitions from high to low. U6A is retriggered each time GRN is logic low and PWM1 transitions from low to high. The failure of the processor 190 to toggle GRN, or to allow either PWM signal to transition between logic high and logic low, for longer than about 0.05 seconds on U6B, or about 0.5 seconds on U6A, will cause U6A or U6B to time out and, upon change of its output to a logic low, will change through the diode D10, D11 OR gate output control signal PASENA to a logic low. PASENA is a logic output signal from control module 13 to power module 15.

As long as the processor 190 is running its main-loop program in a "normal" manner, the signal PASENA is logic high. The PASENA signal enables overcurrent sensing element 110 to generate signals PWMOCL and PWMLCL from which drive circuit logic 90 to generates the gate drive signals PASPOS0, PASNEG0 for the respective power switching transistors Q1–Q2 of the TRACK 1 drive circuit 50 and signals PASPOS1, PASNEG1 for the corresponding transistors of TRACK 2 drive circuit 70, respectively. If the processor 190 fails to correctly operate, the signal PASENA will change to logic low thereby shutting off the gate drive signals to the power transistors of TRACK 1 and TRACK 2 drive circuits 50, 70 as previously described.

While the present invention has been described in terms of the foregoing exemplary embodiment, variations within the scope and spirit of the present invention as defined by the claims following will be apparent to those skilled in the art.

For example, TRACK 1 and TRACK 2 input voltages V1, V2 and auxiliary voltages AUX1, AUX2 could be developed directly by transformer 31 as described or from a separate transformer. Further, input voltages V1 and V2 could be either a low voltage, such as the 27V AC rms developed by transformer 31, or a higher voltage, such as the 110V AC rms, in which case the electronic devices employed in TRACK 1 and TRACK 2 drive circuits 50, 70 are selected to be devices operable with such higher voltage.

Further, TRACK drive circuits 50, 70 could be implemented in other PWM converter topologies, such as PWM bridge converters of full-wave or half-wave form, with or without transformer coupling, as might be preferred if the input voltages V1, V2 were higher, such as 110V AC, and one output was a variable-voltage output.

In the alternative including remote control 12, the functions of display 17 and the drivers 250 and interface 270 therefor, and throttles 19*a*, 19*b* and controls 23 (e.g. buttons S1–S8) and I/O interface 310 therefor, would be duplicated in remote control 12. Signals communicated between remote control 12 and station 5 can be transmitted via a wire or cable 18 or via a wireless communication path 18A, such as a low-power radio link or an infrared (IR) link as are employed with home entertainment products such as televisions and video recorders (VCRs).

Further, it is convenient to limit the range of the PWM signals generated by processor 190. While a range of 0 counts (fully off) to 255 counts (fully on) is possible with the 256 levels available with an eight-bit PWM signal calculation, it may be desirable to limit the PWM signal to a minimum of 1 count and to a maximum of 254 counts. In this manner, irrespective of the mode of operation of station 5, processor 190 will be generating PWM signals having transitions, such as those required for watch dog circuit 290.

While the foregoing description has been cast in terms of a control station 5 for a model train operating on a track, such as a standard O-gauge track, station 5 could also be employed to power and control objects other than model trains including objects to which electrical power is transmitted by guideway or device other than a track or by a wire or cable.

What is claimed is:

1. Electrical control apparatus comprising:

at least two outputs at which respective first and second electrical signals are to be produced;

a controllable first electrical source coupled to at least one of said outputs for supplying said first electrical signals thereto, wherein said controllable electrical source is responsive to a first control signal for controlling the magnitude of said first electrical signal;

a second electrical source coupled to the other of said outputs for supplying said second electrical signal thereto;

a sensing element coupled to receive said first electrical signal and to generate a sensed electrical parameter representative of the magnitude of said first electrical signal; and a processor responsive to said sensed electrical parameter for generating said first control signal; and wherein said processor determines from said sensed electrical parameter whether said two outputs are connected together.

2. The apparatus of claim 1 wherein said sensed electrical parameter includes the voltage on at least one of said two outputs.

3. The apparatus of claim 2 wherein said sensed electrical parameter further includes the current on the other of said two outputs.

4. The apparatus of claim 1 wherein said processor generates said first control signal to produce said first electrical signal having a sequence of two different voltages.

5. Electrical control apparatus comprising:

at least two outputs at which respective first and second electrical signals are to be produced;

a controllable first electrical source coupled to at least one of said outputs for supplying said first electrical signals thereto, wherein said controllable electrical source is responsive to a first control signal for controlling the magnitude of said first electrical signal;

a second electrical source coupled to the other of said outputs for supplying said second electrical signal thereto;

a sensing element coupled to receive said first electrical signal and to generate a sensed electrical parameter representative of the magnitude of said first electrical signal; and a processor responsive to said sensed electrical parameter for generating said first control signal; and wherein said processor calculates from said sensed parameter a value representative of the power level of said first electrical signal, and generates said first control signal to control said power level in relation to a predetermined value.

6. The apparatus of claim 5 wherein said predetermined value is a maximum power level of about 190 watts.

7. A method of detecting an interconnection of at least two outputs of a plural output electrical control station, wherein at least one of the outputs is controllable in response to a control value, comprising the steps of:

measuring a reference measured value of the voltage at at least one of the outputs thereof;

changing the control value of the controllable output in a manner expected to produce a predetermined change of the voltage thereof;

calculating from said reference value and said predetermined change an expected value of a second measured value of the voltage at the controllable output;

measuring at said at least one of the outputs after said changing the control value of the controllable output the second measured value of the voltage thereof;

comparing said second measured value to said calculated expected value; and detecting an interconnection when said second measured value differs from said calculated expected value by more than a predetermined amount.

8. The method of claim 7 wherein the step of changing the control value of the controllable output comprises changing the control of the voltage in a first sense by a first predetermined amount and in a second opposite sense by a second predetermined amount.

9. The method of claim 8 wherein the step of changing the control of the voltage further comprises:

comparing the reference measured value to a predetermined threshold value;

determining said first sense so that said second measured value is removed from said predetermined threshold value by a greater amount than is said reference measured value.

10. The method of claim 9 further comprising setting the values of said first and second predetermined values so that said second measured value does not reach said predetermined threshold value.

11. The method of claim 7 further comprising the steps of:

measuring a reference value of the voltage of the other of said outputs;

comparing the reference measured value at said at least one of the outputs to the reference measured value of the voltage at the other of said outputs; and performing the step of changing the control value of the controllable output only if the respective reference measured values of the voltages of the one of the outputs and of the other of the outputs are substantially equal.

12. The method of claim 7, further comprising the steps of:

measuring at said at least one of the outputs a reference measured value of the current thereof;

comparing said reference measured value of the current to a predetermined current threshold value; and performing the step of changing the control of the voltage only if said reference measured value of the current exceeds said predetermined current threshold value.

13. The method of claim 7 further comprising:

measuring at least the other of the outputs a reference measured value of the current thereof;

measuring at said at least the other of the outputs after said changing the control value of the controllable output a second measured value of the current thereof;

comparing said reference measured value of the current thereof to said second measured value of the current thereof; and detecting an interconnection when said second measured value of the current differs from said reference measured value of the current in a sense opposite to the sense of the expected predetermined change in the voltage at said controllable output.

* * * * *